US012209765B2

(12) United States Patent
Anderson et al.

(10) Patent No.: US 12,209,765 B2
(45) Date of Patent: Jan. 28, 2025

(54) DIFFUSER ASSEMBLY FOR AN HVAC SYSTEM

(71) Applicant: Air Distribution Technologies IP, LLC, Milwaukee, WI (US)

(72) Inventors: Justin E. Anderson, Sachse, TX (US); Ramesh Parjapat, Tadipatri (IN); Neal T. Holden, Allen, TX (US); Tanay Agarwal, Dibrugarh (IN); Janelle G. Gillespie Howard, Richardson, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

(21) Appl. No.: 18/244,757

(22) Filed: Sep. 11, 2023

(65) Prior Publication Data

US 2023/0417447 A1 Dec. 28, 2023

Related U.S. Application Data

(62) Division of application No. 17/071,807, filed on Oct. 15, 2020, now Pat. No. 11,754,311.

(51) Int. Cl.

| | |
|---|---|
| ***F24F 13/062*** | (2006.01) |
| ***F24F 11/74*** | (2018.01) |
| ***F24F 13/12*** | (2006.01) |

(52) U.S. Cl.

CPC ..... *F24F 13/062* (2013.01); *F24F 11/74* (2018.01); *F24F 13/12* (2013.01)

(58) Field of Classification Search

CPC .. F24F 11/74; F24F 11/79; F24F 13/10; F24F 13/12; F24F 13/062

USPC ..... 454/256

See application file for complete search history.

(56) References Cited

U.S. PATENT DOCUMENTS

| | | | |
|---|---|---|---|
| 4,800,804 | A | 1/1989 | Symington |
| 5,584,312 | A | 12/1996 | Van Becelaere |
| 5,647,532 | A | 7/1997 | De Villiers et al. |
| 6,176,777 | B1 | 1/2001 | Smith et al. |
| 6,254,010 | B1 | 7/2001 | De Villiers |
| 7,641,125 | B2 | 1/2010 | Rimmer et al. |
| 10,317,099 | B2 | 6/2019 | Hirsch et al. |
| 2016/0363341 | A1 | 12/2016 | Arens et al. |

FOREIGN PATENT DOCUMENTS

| | | | |
|---|---|---|---|
| EP | 348922 | A2 | 1/1990 |
| EP | 2466221 | A1 | 6/2012 |
| EP | 2096366 | B1 | 10/2015 |
| KR | 20110007377 | U | 7/2011 |

*Primary Examiner* — Allen R. B. Schult

(57) ABSTRACT

A diffuser assembly for a heating, ventilating, and air conditioning (HVAC) system includes a housing having an outer frame and an inner frame disposed within the outer frame. The outer frame includes an inlet configured to receive an air flow. The inner frame forms a first flow path for the air flow through the housing between the outer frame and the inner frame. The inner frame defines a second flow path for the air flow through the inner frame. The diffuser assembly also includes a damper assembly configured to transition between a first configuration to enable discharge of the air flow from the housing via the first flow path and a second configuration to enable discharge of the air flow from the housing via the second flow path.

20 Claims, 11 Drawing Sheets

DIFFUSER ASSEMBLY FOR AN HVAC SYSTEM

CROSS-REFERENCE TO RELATED APPLICATION

This application is a divisional of U.S. patent application Ser. No. 17/071,807, entitled "DIFFUSER ASSEMBLY FOR AN HVAC SYSTEM," filed Oct. 15, 2020, which is hereby incorporated by reference in its entirety for all purposes.

BACKGROUND section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial environments to control environmental properties, such as temperature and humidity, for occupants of the respective environments. The HVAC system may regulate the environmental properties through delivery of a conditioned air flow to the environment. For example, the HVAC system generally includes an HVAC unit that is fluidly coupled to various rooms or spaces within the building via an air distribution system, such as a system of ductwork. The HVAC unit may be operable to direct a heated air flow or a cooled air flow through the ductwork and into the spaces to be conditioned. In this manner, the HVAC unit facilitates regulation of environmental parameters within the rooms or spaces of the building.

A temperature of the conditioned air supplied to the spaces may determine or affect a density of the conditioned air and, thus, a relative buoyancy of the conditioned air, with respect to ambient air within the space. Differentials in buoyancies of the heated or cooled air supplied to the space and the ambient air within the space may affect natural convective forces that induce air dispersion and/or air movement within the space. As such, the distribution of conditioned air within the space may vary based on an operational mode (e.g., heating mode, cooling mode) under which the HVAC unit operates and a discharge direction at which the conditioned air is directed into the space. Unfortunately, conventional HVAC systems may direct conditioned air into spaces of the building at fixed discharge directions, without regard to the temperature of the air being supplied to the spaces and/or the operational mode of the HVAC unit, which may impede effective air distribution across the spaces.

SUMMARY

The present disclosure relates to a diffuser assembly for a heating, ventilating, and air conditioning (HVAC) system. The diffuser assembly includes a housing having an outer frame and an inner frame disposed within the outer frame. The outer frame includes an inlet configured to receive an air flow. The inner frame forms a first flow path for the air flow through the housing between the outer frame and the inner frame. The inner frame defines a second flow path for the air flow through the inner frame. The diffuser assembly also includes a damper assembly configured to transition between a first configuration to enable discharge of the air flow from the housing via the first flow path and a second configuration to enable discharge of the air flow from the housing via the second flow path.

The present disclosure also relates to a diffuser assembly for a heating, ventilating, and air conditioning (HVAC) system. The diffuser assembly includes an outer frame having a first inlet configured to receive an air flow. The diffuser assembly also includes an inner frame disposed within the outer frame and having a second inlet configured to receive the air flow from the first inlet. The inner frame and outer frame form a first outlet of the diffuser assembly therebetween and the inner frame defines a second outlet of the diffuser assembly. The diffuser assembly further includes a damper assembly coupled to the outer frame, the inner frame, or both. The damper assembly is configured to transition between a first configuration to direct the air flow through a first flow path of the diffuser assembly extending from the first inlet to the first outlet and a second configuration to direct the air flow through a second flow path of the diffuser assembly extending from the first inlet, through the second inlet, and to the second outlet.

The present disclosure also relates to a heating, ventilating, and air conditioning (HVAC) system including a diffuser assembly. The diffuser assembly includes an outer frame having an inlet configured to receive an air flow from ductwork. The diffuser assembly also includes an inner frame disposed within the outer frame to form a first flow path for the air flow through the diffuser assembly between the outer frame and the inner frame. The inner frame defines a second flow path, separate from the first flow path, for the air flow through the diffuser assembly. The diffuser assembly further includes a damper assembly configured to transition between a first configuration to enable discharge of the air flow from the diffuser assembly via the first flow path and a second configuration to enable discharge of the air flow from the diffuser assembly via the second flow path. The diffuser assembly also includes an actuator configured to actuate the damper assembly between the first configuration and the second configuration. The HVAC system further includes a controller communicatively coupled to the actuator and configured to instruct the actuator to transition the damper assembly between the first configuration and the second configuration based on an input received via the controller.

DETAILED DESCRIPTION

Figure 1:
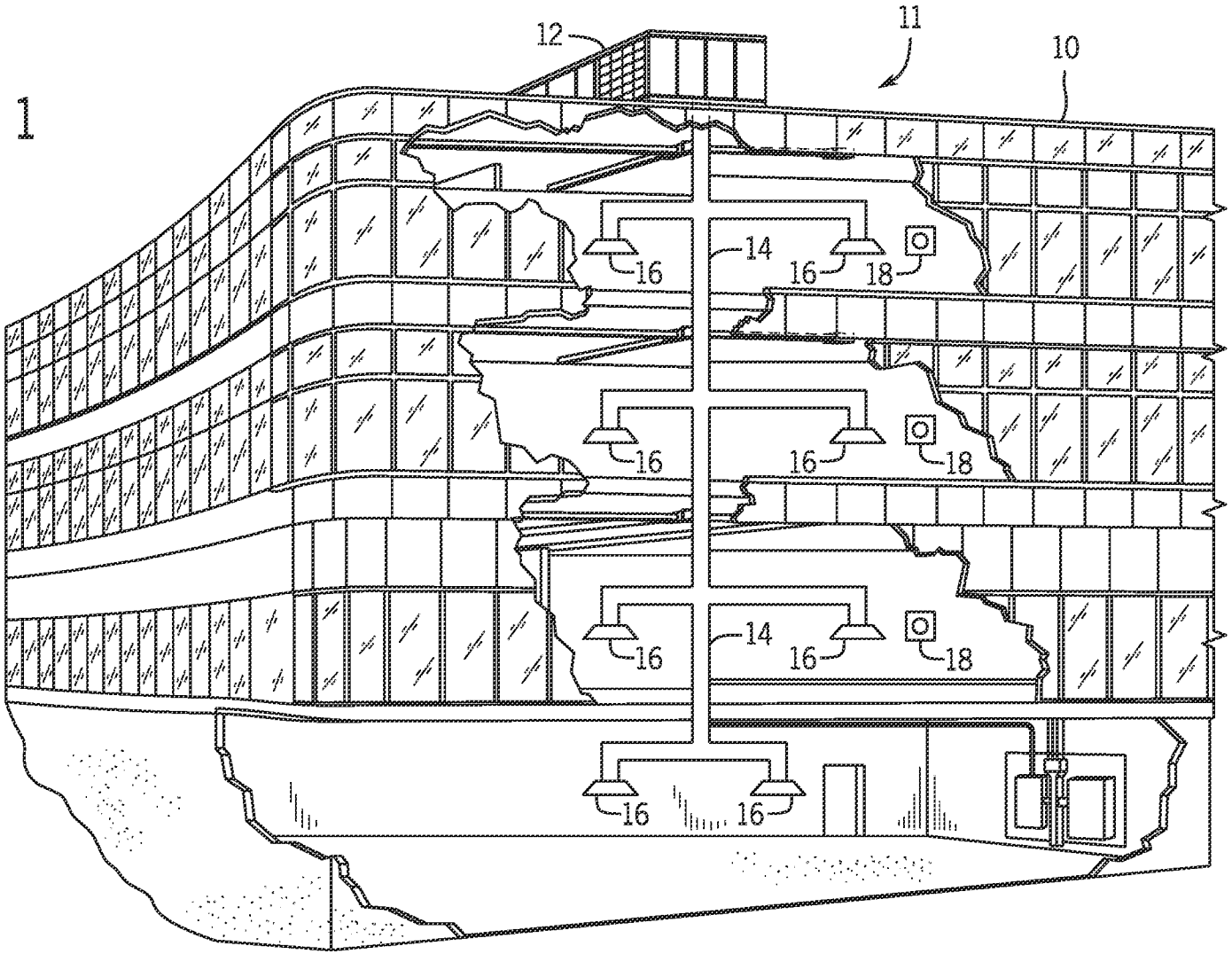
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a space within a building, home, or other suitable structure. The HVAC system may include an HVAC unit configured to condition an air flow via an evaporator, a furnace, a heating coil, a chiller system, or a combination thereof, and to provide the conditioned air flow (e.g., a heated air flow, a cooled air flow) to the space. For example, the HVAC unit may be fluidly coupled to the space via an air distribution system, such as a system of ductwork, which extends between the HVAC unit and the space. As such, one or more fans or blowers of the HVAC system may be operable to direct a supply of conditioned air from the HVAC unit, through the ductwork, and into the spaces within the building.

Typically, the HVAC system includes one or more diffusers that may be fluidly coupled to the ductwork and configured to facilitate distribution of air into the rooms or spaces of the building. For example, the diffusers may be positioned adjacent to ceilings of the rooms or spaces and may be configured to discharge air from the ductwork into the spaces. In many cases, the diffusers direct the discharged air in generally horizontal directions (e.g., with respect to gravity) along the ceilings to facilitate distribution of cooled air across the spaces during cooling operations performed by the HVAC system.

For example, while operating in a cooling mode, the HVAC unit may supply a cooled air flow to the diffuser associated with a particular room or space. Accordingly, the diffuser may discharge the cooled air flow into the space in the generally horizontal directions along the ceiling of the space and across the space. Generally, the flow of cooled air provided by the HVAC unit has a density that is greater than a density of relatively warmer ambient air within the space. As such, buoyancy differentials between the conditioned air discharged from the diffuser and the existing ambient air within the space may cause the conditioned air to sink from the ceiling of the space toward a floor of the space. In this manner, the diffuser may facilitate distribution of cooled air across an interior of the space to be conditioned.

Unfortunately, typical diffusers may be unable to adjust the directions along which the diffusers direct the conditioned air into the rooms or spaces of the building. Therefore, the diffusers may direct the conditioned air into the rooms or spaces in fixed directions (e.g., generally horizontal directions), irrespectively of an operational mode of the HVAC unit. That is, conventional diffusers may direct conditioned air into the rooms or spaces in the same directions regardless of whether the HVAC unit is operating in the cooling mode to supply cooled air to the space, in a heating mode to supply heated air to the space, or in another conditioning mode. The inability to adjust the discharge directions of conventional diffusers may spur undesirable air stratification within the rooms or spaces to be conditioned, particularly while the HVAC system is operating in the heating mode.

For example, during heating operations of the HVAC system, the HVAC unit may supply a heated air flow to the diffusers. Generally, the heated air supplied to the diffusers has a density that is less than a density of the relatively cooler ambient air existing within the space. Accordingly, because typical diffusers direct the heated air into the space in the generally fixed (e.g., horizontal) directions, buoyancy differentials between the heated air discharged from the diffuser and the existing ambient air within the space may cause the heated air to stratify near an upper portion of the space, proximate to the ceiling. As such, the heated air may not be adequately distributed within the room or space (e.g., may not flow toward the floor of the space), which may result in the formation of undesirable temperature gradients along a height (e.g., with respect to gravity) of the space.

It is presently recognized that enabling directionally-adjustable air discharge from the diffuser may mitigate or substantially eliminate stratification of conditioned air within a room or other space to be conditioned by the HVAC system. Accordingly, embodiments of the present disclosure are directed toward a diffuser assembly that enables selective adjustment of a discharge direction of air from the diffuser assembly based on, for example, one more operating parameters of the HVAC system (e.g., a temperature of a heated or cooled supply air flow; an operating mode of the HVAC unit) to reduce or substantially eliminate air stratification within conditioned spaces of a building or other structure.

For example, embodiments of the diffuser assembly disclosed herein include a housing having an outer frame and an inner frame that is positioned within the outer frame. The outer frame includes an inlet that may be fluidly coupled to the HVAC unit via the air distribution system and is configured to receive a conditioned air flow from the HVAC unit. A central axis of the inlet may, in an installed configuration of the diffuser assembly (e.g., when the diffuser assembly is installed within the building), extend in a generally vertical direction with respect to gravity. The outer frame may form a first flow path through the housing that extends between outer frame and the inner frame and is configured to receive the conditioned air flow from the inlet. Moreover, the inner frame defines a second flow path through the housing that is configured to receive the conditioned air flow from the inlet. The first flow path terminates at a first outlet (e.g., discharge outlet) of the housing and the second flow path terminates at a second outlet (e.g., discharge outlet) of the housing. The first outlet may be configured to guide discharge the conditioned air flow from the housing in a first direction that extends generally parallel to the central axis of the inlet, while the second outlet may be configured to guide discharge the conditioned air flow from the housing in second directions that extend generally radially from or oblique to the central axis of the inlet. Accordingly, in the installed configuration of the diffuser assembly, the first outlet may be configured to discharge the conditioned air flow from the housing in a generally vertical direction, with respect to gravity, while the second outlet may be configured to discharge the conditioned air flow from the housing in generally horizontal or lateral directions, with respect to gravity.

The diffuser assembly also includes a damper assembly that is actuatable to selectively enable or disable discharge of air flow through the first outlet or the second outlet. Particularly, the damper assembly may be actuatable between a first configuration or position, in which the damper assembly enables air flow through the first flow path and the first outlet, while blocking air flow through the second flow path and the second outlet, and a second configuration or position, in which the damper assembly enables air flow through the second flow path and the second outlet, while blocking air flow through the first flow path and the first outlet. Accordingly, in the installed configuration of the diffuser assembly, the damper assembly is operable to selectively enable discharge of conditioned air from the diffuser assembly in the generally vertical direction (e.g., through the first outlet), with respect to gravity, or in the generally lateral or horizontal directions (e.g., through the second outlet), with respect to gravity. As such, the diffuser assembly enables adjustment in a discharge direction of air into the room or space based on, for example, the temperature of air supplied to the diffuser assembly and/or the operational mode (e.g., heating mode, cooling mode) of the HVAC unit. To this end, the diffuser assembly enables discharge of conditioned air into the room or space in a manner that enhances air distribution and/or air mixing within the space and minimizes air stratification within the space (e.g., based on a temperature of the discharged air).

As an example, while the HVAC unit is operating in the heating mode, or while a temperature of the conditioned air supplied to the diffuser assembly exceeds a temperature of the existing air within the space to be conditioned, the diffuser assembly may be adjusted to enable discharge of the conditioned air through the first outlet in the generally vertical direction, such that the heated, relatively low-density air is directed into the space in a vertically downward direction (e.g., with respect to gravity) toward the floor of the space. Accordingly, the heated air may disperse across the floor and mix with existing air within the space prior to rising back toward the ceiling of the space. As such, the diffuser assembly may mitigate or substantially eliminate stratification or accumulation of heated air near the ceiling of the space.

Conversely, while the HVAC unit is operating in the cooling mode, or while the temperature of the conditioned air supplied to the diffuser assembly is less than the temperature of the existing air within the space to be conditioned, the diffuser assembly may be adjusted to enable discharge of the conditioned air through the second outlet in the generally lateral or horizontal directions, such that the cooled, relatively high-density air is directed into the space in radially outward directions (e.g., with respect to the diffuser assembly) along the ceiling. As such, the cooled air may travel along the ceiling of the space and distribute within the space prior to sinking toward the floor of the space.

As discussed in detail herein, the diffuser assembly may include an actuator, such as a linear actuator, a pneumatic actuator, a worm-drive assembly, or another suitable actuator, that is configured to actuate the damper assembly to transition the damper assembly between the first and second configurations. The actuator may be communicatively coupled to a controller that is configured to control the actuator based on one or more operating parameters of the HVAC system including, for example, an operating mode of the HVAC unit, a temperature of the conditioned air supplied to the diffuser assembly, a temperature of existing (e.g., ambient) air within a space to be conditioned by the HVAC unit, and/or other suitable parameters. Additionally or alternatively, the controller may adjust operation of the actuator based on user input received via a user interface (e.g., a graphical user interface), for example. It should be appreciated that, in some embodiments, the controller may instruct the actuator to position the damper assembly in an intermediate configuration or position that is between the first and second configurations to simultaneously enable discharge of conditioned air through the first outlet and the second outlet of the diffuser assembly. Moreover, it should be understood that the controller may be coupled to, for example, the housing of the diffuser assembly, or may be positioned remote of the diffuser assembly. That is, in some embodiments, the controller may be a supervisory controller of the HVAC system, a thermostat of the HVAC system, or another suitable controller of the HVAC system that is communicatively coupled to and configured to control operation of the actuator. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by an HVAC system 11 having an HVAC unit 12. The building 10 may be a commercial structure or a residential structure. As shown, the HVAC unit 12 is disposed on the roof of the building however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building 10. In the illustrated embodiment, the HVAC unit 12 is a rooftop unit (RTU) that conditions a supply air stream, such as environmental air and/or a return air flow from the building 10. The HVAC unit 12 may provide a variety of heating and/or cooling functions, such as cooling only, heating only, cooling with electric heat, cooling with dehumidification, cooling with gas heat, or cooling with a heat pump. For example, in certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

In any case, after the HVAC unit 12 conditions the air, the air may be supplied to the building 10 via ductwork 14 extending from the HVAC unit 12 and throughout the building 10. For example, the ductwork 14 may extend to various individual floors, rooms zones, or other sections or spaces of the building 10. In the illustrated embodiment, a plurality of diffuser assemblies 16 is coupled to the ductwork 14. As discussed in detail herein, the diffuser assemblies 16 may direct the conditioned air into the various spaces of the building 10 in a manner that improves air distribution and/or air dispersion across the spaces.

In some embodiments, a control device 18, one type of which may be a thermostat, may be used to designate the temperature of the conditioned air supplied by the HVAC unit 12. The control device 18 also may be used to control the flow of air through the ductwork 14. For example, the control device 18 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of supply air, return air, and so forth. Moreover, the control device 18 may include computer systems that are integrated with or separate from other building control or monitoring systems, and even systems that are remote from the building 10.

Figure 2:
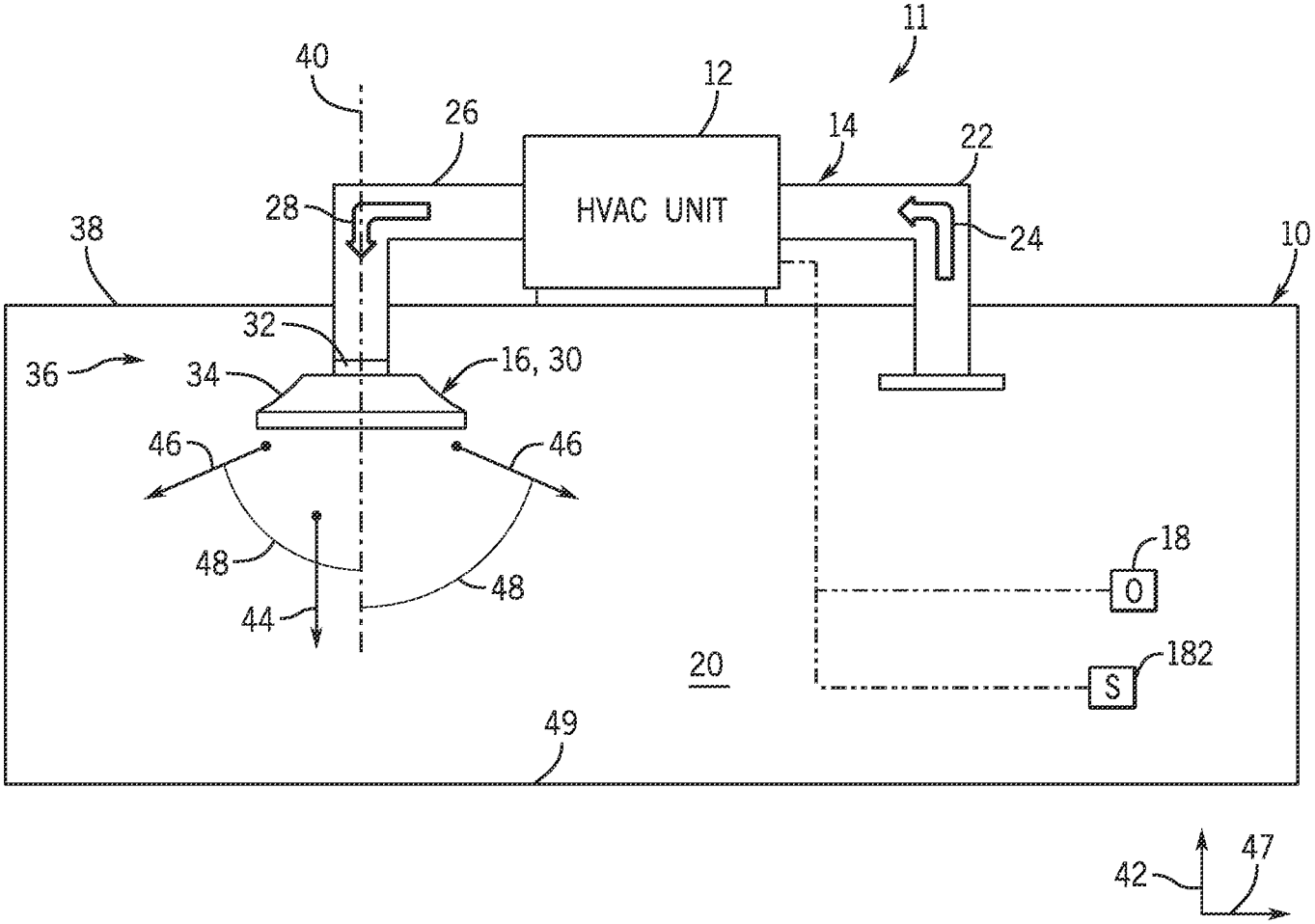
FIG. 2 is a schematic of an embodiment of the HVAC system of FIG. 1 that includes a diffuser assembly, in accordance with an aspect of the present disclosure.

FIG. 2 is a schematic of an embodiment of a portion of the building 10 and of the HVAC system 11. As discussed above, the HVAC unit 12 is configured to condition an air flow that is supplied to a space 20 within the building 10, which may include a room, a zone, a floor, and/or another suitable region within the building 10. The ductwork 14 may include a return air duct 22 that enables the HVAC unit 12 to draw a flow of return air 24 from the space 20 and a supply air duct 26 that enables the HVAC unit 12 to direct a supply air flow 28 (e.g., heated air, cooled air) into the space 20. In the illustrated embodiment, one of the diffuser assemblies 16, referred to herein as a diffuser assembly is coupled to the supply air duct 26 at an inlet 32 of the diffuser assembly 30. The inlet 32 is configured to receive the supply air flow 28 from the supply air duct 26 and to direct the supply air flow 28 into a housing 34 of the diffuser assembly 30. The housing 34 may subsequently discharge the supply air flow 28 from the diffuser assembly 30 into the space 20.

In an installed configuration 36 of the diffuser assembly 30 within the building 10, the diffuser assembly 30 may be positioned near a ceiling 38 of the space 20. Specifically, in the installed configuration 36, the diffuser assembly 30 may be coupled to the ceiling 38 or to a support structure suspended from the ceiling 38, such as an array of ceiling tiles. In some embodiments, in the installed configuration 36, the diffuser assembly 30 may be positioned and/or oriented such that an axis 40 (e.g., a central axis) extending through the inlet 32 is aligned generally parallel to a vertical axis 42 extending along a direction of gravity. For clarity, it should be understood that the axis 40 may extend along a direction of air flow through the inlet 32. Moreover, it should be understood that, as used herein, discussions relating to axes (and/or directions) being "generally" parallel to or aligned with other reference axes (and/or reference directions) are intended to denote that the axes are within a threshold orientational range of the references axes, such as within 1 degree of, within 5 degrees of, or within 10 degrees of the reference axes.

As discussed in detail herein, the diffuser assembly 30 is adjustable to selectively discharge the supply air flow 28 into the space 20 along a first direction 44, which extends generally parallel to the axis 40 and the vertical axis 42, or a set of second directions 46, which extend oblique to (e.g., radially or laterally from) the axis 40. For clarity, as used herein, discussions relating to axes (and/or directions) being oblique to other reference axes (and/or reference directions) are intended to denote that the axes are angled from the reference axes by threshold orientational range, such as, for example, more than approximately 15 degrees. Thus, as a non-limiting example, it should be appreciated that respective angles 48 between the axis 40 and the second directions 46 may be between approximately 15 degrees and approximately 45 degrees, between approximately 30 degrees and approximately 60 degrees, or between approximately 45 degrees and approximately 90 degrees. As used herein, the term "approximately," when used with respect to discussions of an angle or axis, is intended to denote that the angle or axis is within, for example, 2 degrees of the discussed value of the angle or axis. In some embodiments, the second directions 46 may, in the installed configuration 36 of the diffuser assembly 30, extend generally parallel to a horizontal axis 47 that extends orthogonal to the vertical axis 42.

In view of the foregoing, it should be appreciated that, in the installed configuration 36, the diffuser assembly 30 may guide discharge the supply air flow 28 into the space 20 along a vertical direction (e.g., the first direction 44) that extends generally along the vertical axis 42 and toward a floor 49 of the space 20, or along lateral directions (e.g., the second directions 46) that extend generally away from the vertical axis 42 (e.g., along the horizontal axis 47). As discussed in detail below, the diffuser assembly 30 may selectively adjust a discharge direction of the supply air flow 28 (e.g., between the first and second directions 44, 46) to mitigate or substantially eliminate the shortcomings of typical diffusers described above.

Figure 3:
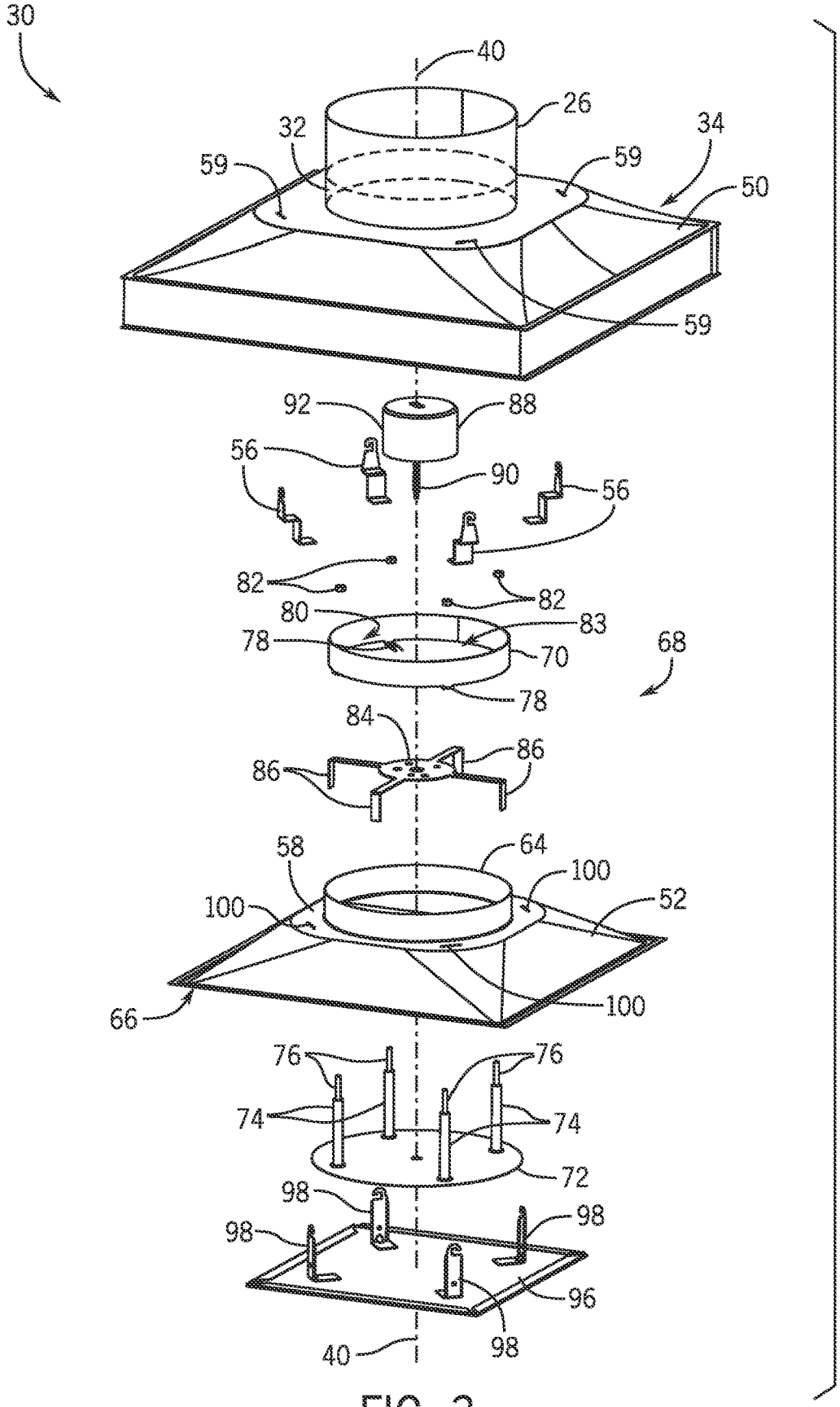
FIG. 3 is a perspective exploded view of an embodiment of the diffuser assembly of FIG. 2, in accordance with an aspect of the present disclosure.

To better illustrate the diffuser assembly 30 and to facilitate the following discussion, FIG. 3 is a perspective exploded view of an embodiment of the diffuser assembly 30. As discussed above, the diffuser assembly 30 includes the inlet 32 that is configured to couple to, for example, the supply air duct 26. The housing 34 includes an outer frame 50, which may define the inlet 32, and an inner frame 52 configured to couple to the outer frame 50 via a plurality of connectors 56, for example. The connectors 56 may be coupled to a panel 58 of the inner frame 52 via a metallurgical process, such as welding or brazing, an adhesive, and/or fasteners, and may engage with corresponding slots 59 formed in the outer frame 50 to facilitate coupling of the inner frame 52 to the outer frame Particularly, the connectors 56 may be configured to suspend the inner frame 52 within the outer frame 50, such that, in an installed configuration of the inner frame 52 with the outer frame 50, the inner frame 52 is disposed at least partially within the outer frame 50. In other embodiments, the outer frame 50 may be coupled to the inner frame 52 via any other suitable support structure.

In the installed configuration of the inner frame 52 with the outer frame 50, a first flow path 60 (FIG. 4) through the housing 34 is defined and extends between the inner frame 52 and the outer frame 50. Moreover, the inner frame 52 defines a second flow path 62 (FIG. 4) through the housing 34 that extends through an additional inlet 64 of the inner frame 52 and terminates at an end portion 66 of the inner frame 52. As discussed in detail herein, the diffuser assembly 30 includes a damper assembly 68 that, in an assembled configuration of the diffuser assembly 30, is actuatable to selectively direct the supply air flow 28, or another air flow received via the inlet 32, into the first flow path 60 or the second flow path 62 (e.g., via the additional inlet 64) of the housing 34.

In some embodiments, the damper assembly 68 includes a perimetrical sleeve (e.g., annular damper, ring-shaped damper, sleeve, perimetrical damper) and a damper plate 72 that are fixedly coupled to one another via a plurality of columns 74 (e.g., extensions, rods, spacers) extending from the damper plate 72. For example, the columns 74 may each include a threaded portion 76 that is formed near a distal end of the columns 74 (e.g., distal to the damper plate 72). The threaded portions 76 may be configured to extend through apertures formed within respective tabs 78 of the perimetrical sleeve 70. The tabs 78 may be integrally formed with the perimetrical sleeve 70 and extend from a radially-inner surface 80 of the perimetrical sleeve 70. In other embodiments, the tabs 78 may be separate components that are coupled to the perimetrical sleeve 70. In any case, upon extension of the threaded portions 76 through corresponding apertures of the tabs 78, retention fasteners (e.g., nuts) 82 may be used to fixedly couple the columns 74, and thus the damper plate 72, to the perimetrical sleeve 70. In other embodiments, the damper plate 72 may be coupled to the perimetrical sleeve 70 in any other suitable manner. For clarity, as used herein, the "perimetrical sleeve" 70 or a "perimetrical damper" is intended to encompass any sleeve or damper having an outer wall or shell that defines a fluid passage 83 through an interior of the perimetrical sleeve 70. As such, the perimetrical sleeve 70 may be indicative of an annular damper or a damper having another suitable cross-sectional profile that suitably forms the fluid passage 83.

In the illustrated embodiment, the diffuser assembly 30 includes a support frame 84 that is configured to fixedly coupled to the inner frame 52 via a plurality of legs 86. As an example, the legs 86 may be configured to couple to the additional inlet 64 of the inner frame 52. The support frame 84 is configured to receive, support, and/or couple to an actuator 88 to support the actuator 88 within the housing 34. As discussed below, the actuator 88 is configured to couple to and drive operation the damper assembly 68 to facilitate operation of the diffuser assembly 30 in accordance with the techniques discussed herein. As such, the actuator 88 and related components (e.g., a controller configured to control the actuator 88) may form an actuation system configured to selectively drive movement of the damper assembly 68. As a non-limiting example, the actuator 88 may include a linear actuator, a pneumatic actuator, a worm-drive assembly, or any other suitable actuator or device configured to drive operation of the damper assembly 68.

The actuator 88 may include an actuated connector 90 that extends from an enclosure 92 of the actuator 88 and is configured to couple to the damper plate 72. In some embodiments, in an installed configuration of the actuator 88 with the damper assembly 68, the actuated connector 90 may extend generally parallel and/or collinear to the axis 40 of the inlet 32. The actuator 88 is configured to retract the actuated connector 90 into the enclosure 92 or extend the actuated connector 90 from the enclosure 92 by translating the actuated connector 90 along the axis 40. Accordingly, in the installed configuration of the actuator 88 with the damper assembly 68, the actuator 88 may translate of the actuated connector 90 into or out of the enclosure 92 to drive movement of the damper assembly 68 along the axis 40, relative to the housing 34.

In some embodiments, the diffuser assembly 30 includes a cover plate 96 that is coupled to the inner frame 52 via a plurality of links 98, for example. The links 98 may be welded or otherwise coupled to the cover plate 96 and configured to engage with corresponding slots 100 formed in the inner frame 52 to facilitate coupling of the cover plate 96 to the inner frame 52. Although the outer frame 50, the inner frame 52, and the cover plate 96 are each illustrated as having a generally quadrilateral cross-section in the illustrated embodiment of FIG. 3, it should be appreciated that, in other embodiments, the outer frame 50, the inner frame 52, and/or the cover plate 96 may have any other suitable cross-sectional profiles or geometries. Further, although the inlet 32, the additional inlet 64, the perimetrical sleeve 70, and the damper plate 72 are each illustrated as having a generally circular cross-section in the illustrated embodiment of FIG. 3, in other embodiments, the inlet 32, the additional inlet 64, the perimetrical sleeve 70, and/or the damper plate 72 may have any other suitable cross-sectional profiles or geometries.

Figure 4:
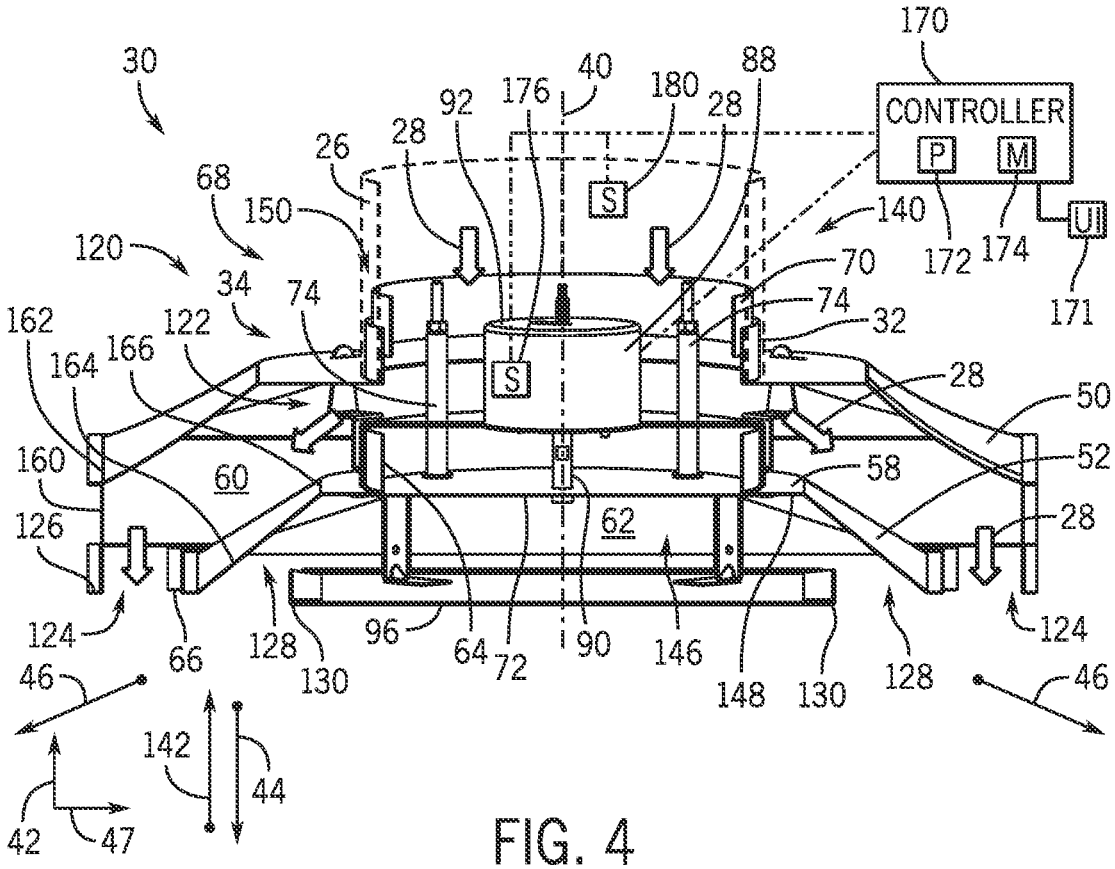
FIG. 4 is a cross-sectional elevation view of an embodiment of the diffuser assembly of FIG. 3, illustrating a damper assembly of the diffuser assembly in a first configuration, in accordance with an aspect of the present disclosure.

FIG. 4 is a cross-sectional elevation view of an embodiment of the diffuser assembly 30 in an assembled configuration 120. In the assembled configuration 120 of the diffuser assembly 30, the inner frame 52 may be positioned within the outer frame 50 such that a gap 122 (e.g., an annular gap) extends between the inlet 32 of the outer frame 50 and the additional inlet 64 of the inner frame 52. The first flow path 60 may extend from the gap 122, along a space between the outer and inner frames 50, 52, and terminate at a first outlet (e.g., discharge outlet) 124 of the housing 34. As shown in the illustrated embodiment, the first outlet 124 may be formed between an end portion 126 of the outer frame 50 and the end portion 66 of the inner frame 52. The second flow path 62 may extend from the additional inlet 64, along an interior of the inner frame 52, and terminate at a second outlet (e.g., discharge outlet) 128 of the housing 34, which may be formed between the end portion 66 of the inner frame 52 and an end portion 130 (e.g., an outer edge) of the cover plate 96. In embodiments of the diffuser assembly 30 that do not include the cover plate 96, the second outlet 128 may be defined by the end portion 66 of the inner frame 52 or by, for example, a distal, inner, or outer edge of the inner frame 52.

In the illustrated embodiment of FIG. 4, the damper assembly 68 is positioned in a first configuration 140 or position, in which the damper assembly 68 is configured to enable air flow through the first flow path 60 and block air flow through the second flow path 62. To transition the damper assembly 68 to the first configuration 140, the actuator 88 may retract the actuated connector 90 into the enclosure 92 to move the damper assembly 68 in a third direction 142 along the axis 40. Specifically, the actuator 88 may move the damper assembly 68 in the third direction 142 until the damper plate 72 reaches a first position 146 in which the damper plate 72 engages (e.g., contacts) an abutment surface (e.g., lower surface) 148 or edge of inner frame 52, such as an inner surface of the panel 58. As such, the actuator 88 may enable the damper plate 72 to, via engagement with the abutment surface 148, form a fluid seal along a perimeter of the additional inlet 64 to block fluid flow through the additional inlet 64. In some embodiments, a gasket or other sealing material may be disposed along a perimeter of the damper plate 72 to facilitate formation of the fluid seal when the damper plate 72 engages the abutment surface 148.

The columns 74 of the damper plate 72 may be sized such that, when the damper plate 72 engages the abutment surface 148, the columns 74 position the perimetrical sleeve in a second position 150 in which the perimetrical sleeve 70 is axially offset (e.g., with respect to the axis 40) from the gap 122. In other words, in the second position 150, the perimetrical sleeve 70 and the gap 122 do not radially overlap with one another (e.g., with respect to the axis 40). Specifically, the columns 74 may position the perimetrical sleeve within or above the inlet 32 of the outer frame 50, such that the perimetrical sleeve 70 exposes or unblocks the gap 122 in the second position 150. As such, while in the second position 150, the perimetrical sleeve 70 enables substantially uninhibited fluid flow through the gap 122 and into the first flow path 60 from the inlet 32. To this end, while the damper assembly 68 is in the first configuration 140, the perimetrical sleeve 70 and the damper plate 72 may cooperate to direct substantially all fluid (e.g., the supply air flow 28) entering the inlet 32 into the first flow path 60 to enable the diffuser assembly 30 to discharge the fluid via the first outlet 124, while substantially blocking fluid flow through the second flow path 62 and out of the diffuser assembly 30 via the second outlet 128.

Figure 5:
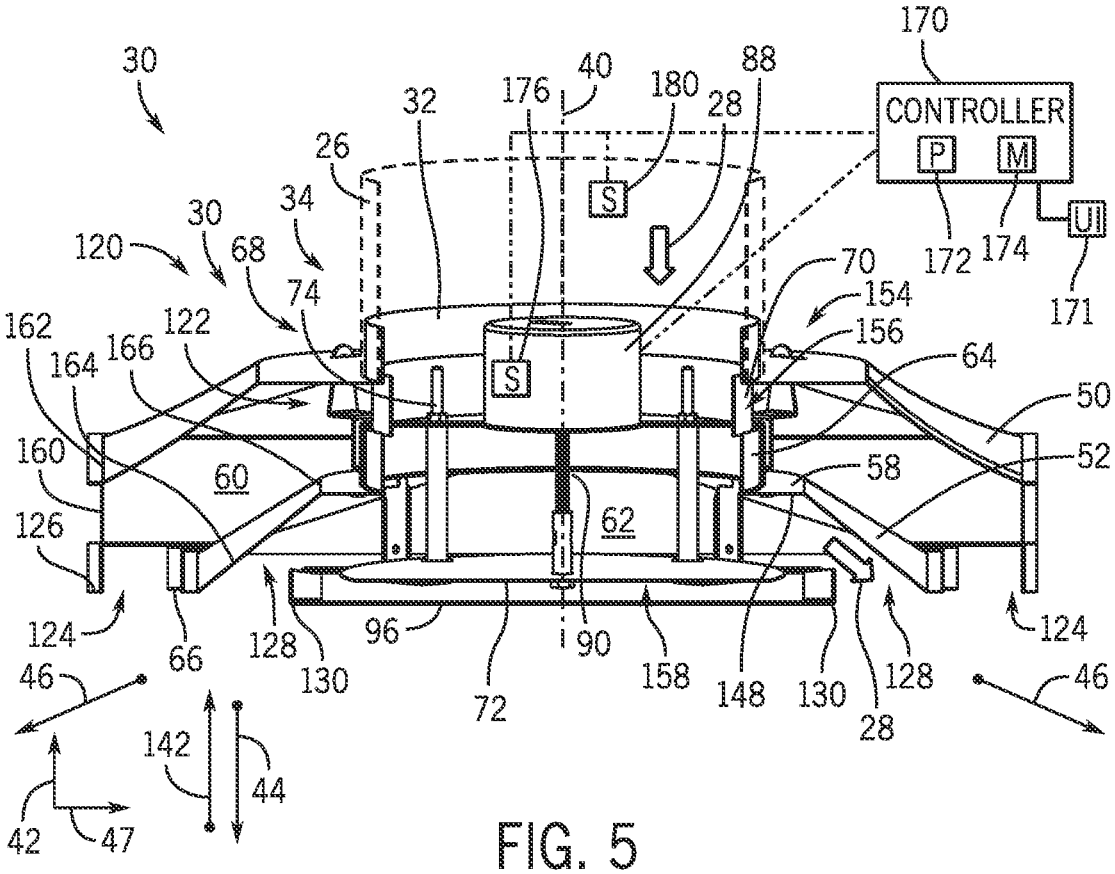
FIG. 5 is a cross-sectional elevation view of an embodiment of the diffuser assembly of FIG. 3, illustrating the damper assembly of the diffuser assembly in a second configuration, in accordance with an aspect of the present disclosure.

FIG. 5 is a cross-sectional elevation view of an embodiment of the diffuser assembly 30, illustrating the damper assembly 68 positioned in a second configuration 154 or position to enable air flow through the second flow path 62 and to block air flow through the first flow path 60. To transition the damper assembly 68 to the second configuration 154, the actuator 88 may extend the actuated connector 90 from the enclosure 92 to drive movement of the damper assembly 68 in the first direction 44, opposite to the third direction 142, along the axis 40. Specifically, the actuator 88 may move the damper assembly 68 in the first direction 44 until the perimetrical sleeve 70 reaches a third position 156, in which the perimetrical sleeve 70 covers or blocks the gap 122. As such, the actuator 88 may enable the perimetrical sleeve 70 to form a fluid seal between the inlet 32 and the additional inlet 64 to substantially inhibit air flow into the first flow path 60 and to guide air flow into the second flow path 62. In some embodiments, in the third position 156 of the perimetrical sleeve 70, the perimetrical sleeve 70 may overlap with at least a portion of the inlet 32 and the additional inlet 64. Moreover, in certain embodiments, a radially-outer surface of the perimetrical sleeve 70 may engage (e.g., contact) respective radially-inner surfaces of the inlet 32 and/or the additional inlet 64 in the third position 156 of the perimetrical sleeve 70. In some embodiments, a gasket or other sealing material may be disposed along the outer perimeter of the perimetrical sleeve 70 and/or inner surfaces of the inlet 32 and/or additional inlet 64 to facilitate formation of the fluid seal across the gap 122 when the perimetrical sleeve 70 engages the radially-inner surfaces of the inlet 32 and/or the additional inlet 64.

The columns 74 extending from the damper plate 72 may be sized such that, when the perimetrical sleeve 70 is in the third position 156, the damper plate 72 is in a fourth position 158, in which the damper plate 72 unblocks or exposes the additional inlet 64. Specifically, in the fourth position 158, the damper plate 72 may be positioned adjacent to the cover plate 96 and/or may contact the cover plate 96. For example, in some embodiments, a gasket coupled to, for example, a perimeter of the damper plate 72, may contact the cover plate 96 while the damper plate 72 is in the fourth position 158. In any case, while in the fourth position 158, the damper plate 72 enables substantially uninhibited fluid flow through additional inlet 64 and into the second flow path 62. Accordingly, while the damper assembly 68 is in the second configuration 154, the perimetrical sleeve 70 and the damper plate 72 may cooperate to guide substantially all fluid (e.g., the supply air flow 28) entering the inlet 32 to the second flow path 62 to enable the diffuser assembly 30 to discharge the fluid via the second outlet 128, while substantially blocking fluid flow through the first flow path 60 and out of the diffuser assembly 30 via the first outlet 124.

The following discussion continues with concurrent reference to FIGS. 4 and 5. In some embodiments, the outer frame 50 includes a first wall 160 that extends generally along the axis 40 from a first vertex 162 of the outer frame 50 to the end portion 126 of the outer frame 50. Thus, in the installed configuration 36 of the diffuser assembly 30, the first wall 160 may extend generally along the vertical axis 42. The inner frame 52 includes a second wall 164 that may extend from a second vertex 166 of the inner frame 52 to the end portion 66 of the inner frame 52, while diverging radially or laterally from the axis 40. Particularly, corresponding portions of the second wall 164 may extend generally along the second directions 46.

As the HVAC unit 12 directs the supply air flow 28 into the inlet 32, and while the damper assembly 68 is in the first configuration 140 (FIG. 4), the supply air flow 28 entering the first flow path 60 may impinge upon a radially-inner surface (e.g., with respect to this axis 40) of the first wall 160. As such, the first wall 160 may redirect the supply air flow 28 flowing along the first flow path 60 in the first direction 44 to enable discharge of the supply air flow 28 from the diffuser assembly 30 via the first outlet 124 in the first direction 44 (e.g., generally along the vertical axis 42). In contrast, as the HVAC unit 12 directs the supply air flow 28 into the inlet 32, and while the damper assembly 68 is in the second configuration 154 (FIG. 5), the supply air flow 28 entering the second flow path 62 may impinge upon and/or otherwise flow along (e.g., due to Coanda effect-induced forces) a radially-inner surface (e.g., with respect to this axis 40) of the second wall 164. As such, the second wall 164 may redirect the supply air flow 28 flowing along the second flow path 62 in the second directions 46 to enable discharge of the supply air flow 28 from the diffuser assembly 30 via the second outlet 128 in the second directions 46 (e.g., generally lateral directions relative to the vertical axis 42).

In some embodiments, the diffuser assembly 30 may include a controller 170 that is configured to adjust, via instructions sent to the actuator 88, the damper assembly 68 between the first configuration 140 and the second configuration 154. Specifically, as discussed below, the controller 170 may operate the actuator 88, and the damper assembly 68 coupled thereto, to adjust a discharge direction of the supply air flow 28 from the diffuser assembly 30 based on, for example, one or more operating parameters of the HVAC system 11 and/or user input (e.g., as received via a user interface 171 communicatively coupled to the controller 170). The user interface 171 may include an interface of the control device 18, a control panel of the HVAC unit 12, a mobile device (e.g., phone, tablet, laptop), or another suitable device configured to receive user input and transmit the user input to the controller 170. In some embodiments, the controller 170 may be a dedicated control device of the diffuser assembly 30 that is coupled to a portion of the housing 34. In other embodiments, the controller 170 may include a supervisory controller of the HVAC system 11, a controller of the HVAC unit 12, control circuitry of one of the control devices 18, and/or any other suitable controller. The controller 170 includes a processor 172, such as a microprocessor, which may execute software for controlling the actuator 88 and/or other components of the diffuser assembly 30 and/or the HVAC system 11. Moreover, the processor 172 may include multiple microprocessors, one or more "general-purpose" microprocessors, one or more special-purpose microprocessors, and/or one or more application specific integrated circuits (ASICS), or some combination thereof. For example, the processor 172 may include one or more reduced instruction set (RISC) processors.

The controller 170 may also include a memory (e.g., a memory device) 174 that may store information such as control software, look up tables, configuration data, executable instructions, and any other suitable data. The memory 174 may include a volatile memory, such as random access memory (RAM), and/or a nonvolatile memory, such as read-only memory (ROM). The memory 174 may store a variety of information and may be used for various purposes. For example, the memory 174 may store processor-executable instructions including firmware or software for the processor 172 execute, such as instructions for controlling the actuator 88 and/or other components of the diffuser assembly 30 and/or the HVAC system 11. In some embodiments, the memory 174 is a tangible, non-transitory, machine-readable-medium that may store machine-readable instructions for the processor 172 to execute. The memory 174 may include ROM, flash memory, a hard drive, or any other suitable optical, magnetic, or solid-state storage medium, or a combination thereof.

In some embodiments, the controller 170 may instruct the actuator 88 to transition the damper assembly 68 between the first and second configurations 140, 154 based on feedback indicative of an operational mode according to which the HVAC unit 12 is operating. For example, upon receiving feedback indicating that the HVAC unit 12 is operating in a heating mode, the controller 170 may instruct the actuator 88 to transition the damper assembly 68 to the first configuration 140 to enable discharge of heated air (e.g., heated supply air 28) through the first outlet 124, while substantially blocking airflow through the second outlet 128. Accordingly, the controller 170 may ensure that, while the HVAC unit 12 is operating in the heating mode, the diffuser assembly 30 discharges the heated supply air 28 in the first direction 44 (e.g., a direction extending generally along the vertical axis 42) to mitigate stratification of heated air along, for example, the ceiling 38 of the space 20 (FIG. 1). Conversely, upon receiving feedback indicating that the HVAC unit 12 is operating in a cooling mode, the controller 170 may instruct the actuator 88 to transition the damper assembly 68 to the second configuration 154 to enable discharge of cooled air (e.g., cooled supply air 28) through the second outlet 128, while substantially blocking airflow through the first outlet 124. Accordingly, the controller 170 may ensure that, while the HVAC unit 12 is operating in the cooling mode, the diffuser assembly 30 discharges the cooled supply air 28 in the second directions 46 (e.g., directions extending generally laterally from the vertical axis 42; directions extending oblique to the axis 40). The controller 170 may be configured to determine a current position of the damper assembly 68 based on feedback from the actuator 88 and/or feedback from a sensor 176 (e.g., a proximity sensor) of the diffuser assembly 30.

In some embodiments, the controller 170 may be configured to transition the damper assembly 68 between the first and second configurations 140, 154 based on temperature feedback received from one or more temperature sensors of the HVAC system 11. For example, the controller 170 may be communicatively coupled to a first temperature sensor 180 configured to provide the controller 170 with feedback indicative of a temperature of the supply air flow 28 and a second temperature sensor 182 (FIG. 2; the control device 18) positioned within the space 20 and configured to provide the controller 170 with feedback indicative of an ambient or existing air temperature within the space 20.

As an example, upon receiving feedback from the sensors 180, 182 indicating that the temperature of the supply air flow 28 exceeds the ambient or existing air temperature within the space 20 by a first threshold amount, the controller 170 may be configured to transition the damper assembly 68 to the first configuration 140. As such, the controller 170 enables the diffuser assembly 30 to discharge relatively warm supply air flow 28 in the first direction 44 (e.g., toward the floor 49 of the space 20) to mitigate or substantially eliminate stratification of the relatively warmer supply air 28 within the an upper portion of the space 20 (e.g., near the ceiling 38). In some embodiments, the controller 170 may maintain the damper assembly 68 in the first configuration 140 until receiving feedback from the sensors 180 and/or 182 indicating that the temperature of the supply air flow 28 falls below the temperature of the ambient or existing air within the space 20 by a second threshold amount. The controller 170 may be configured to transition the damper assembly 68 to the second configuration 154 upon determining that temperature of the supply air flow 28 falls below the temperature of the ambient or existing air within the space 20 by the second threshold amount. As such, when the supply air flow 28 is cooler than the ambient or existing air within the space 20, the controller 170 enables the diffuser assembly 30 to discharge the relatively cooler supply air flow 28 in the second directions 46 into the space 20 and along, for example, the ceiling 38 of the space 20.

It should be understood that, in other embodiments, the controller 170 may be configured to transition the damper assembly 68 between the first and second configurations 140, 154 based on any other suitable sensor feedback and/or control signals in addition to, or in lieu of, the examples discussed above. In some embodiments, the controller 170 may transition the damper assembly 68 between the first and second configurations 140, 154 based on feedback from the sensor 180, the sensor 182, or from the user interface 171. Moreover, it should be appreciated that, in certain embodiments, the controller 170 may be configured to instruct the actuator 88 to position the damper assembly 68 in an intermediate configuration between the first configuration 140 and the second configuration 154, in which the damper assembly 68 may simultaneously expose at least a portion of the gap 122 and uncover at least a portion of the additional inlet 64. As such, in the intermediate configuration, the diffuser assembly 30 may simultaneously discharge the supply air flow 28 through both the first and second outlets 124, 128.

Figure 6:
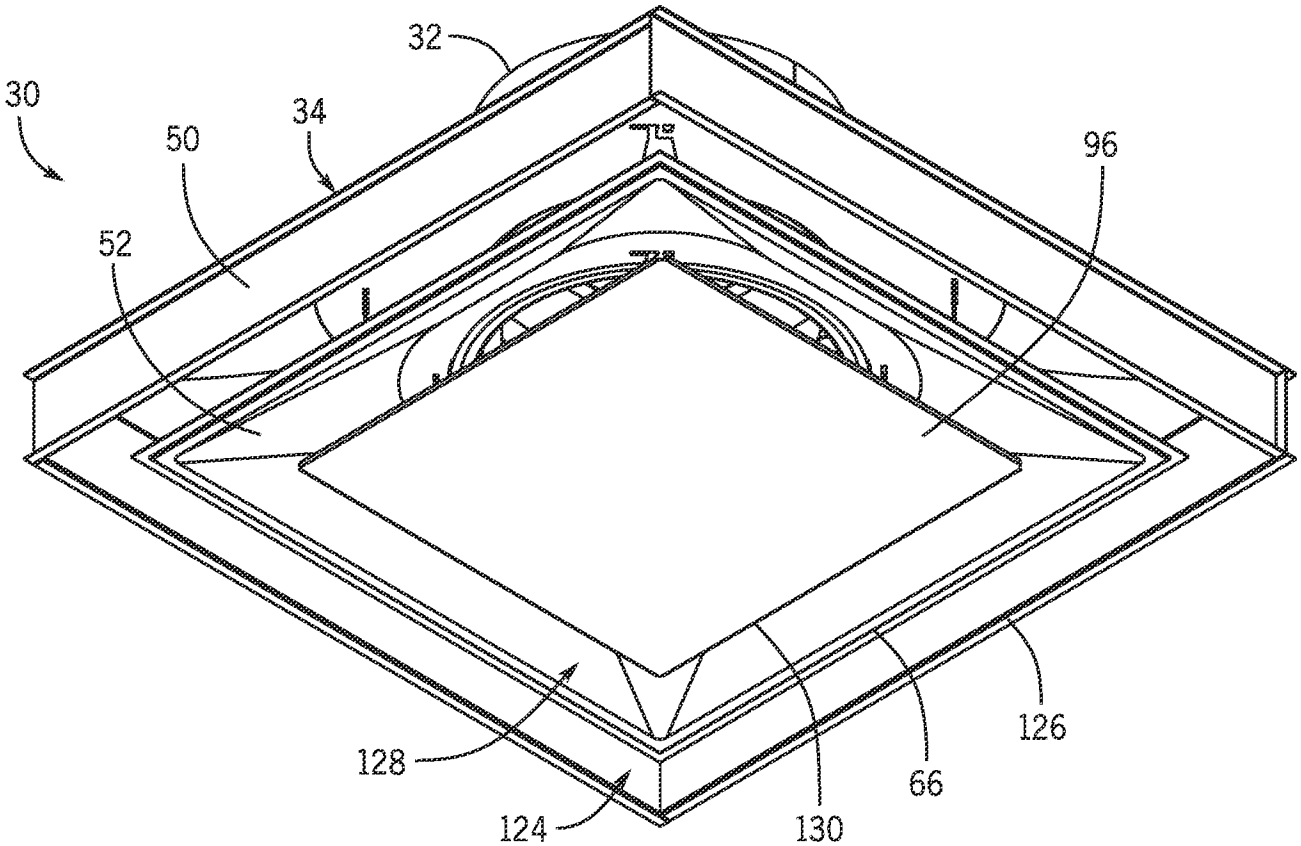
FIG. 6 is a bottom perspective view of an embodiment of the diffuser assembly of FIG. 3, in accordance with an aspect of the present disclosure.

FIG. 6 is a bottom perspective view of an embodiment of the damper assembly 68. As shown in the illustrated embodiment, the first outlet 124 may extend about or otherwise encircle the second outlet 128. The cover plate 96 may, in the installed configuration 36 of the diffuser assembly 30 with the ceiling 38, obstruct or otherwise obscure a line of sight to the additional inlet 64, components of the damper assembly 68, and/or other components of the diffuser assembly 30 to enhance an aesthetic appearance of the diffuser assembly 30.

Figure 7:
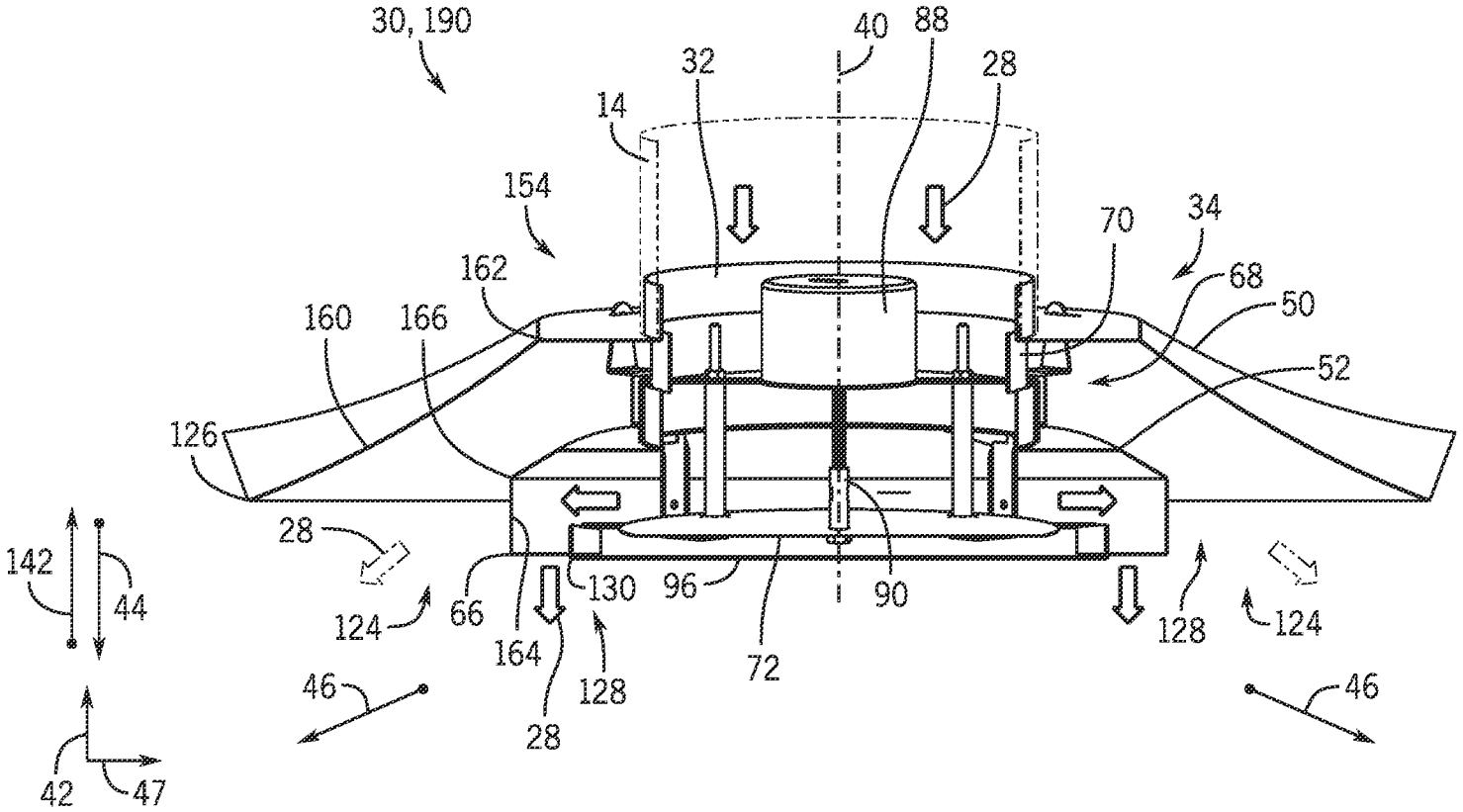
FIG. 7 is a cross-sectional elevation view of an embodiment of the diffuser assembly of FIG. 2, in accordance with an aspect of the present disclosure.

FIG. 7 is a cross-sectional elevation view of another embodiment of the diffuser assembly 30, referred the herein as a diffuser assembly 190, in which the outer frame 50 is configured to discharge the supply air flow 28 through the first outlet 124 in the second directions 46 (instead of the first direction 44) and in which the inner frame 52 is configured to discharge the supply air flow 28 through the second outlet 128 in the first direction 44 (instead of the second directions 46).

For example, in the illustrated embodiment, the first wall 160 of the outer frame extends from the first vertex 162 to the end portion 126, while diverging radially or laterally from the axis 40, such that first vertex 162 is positioned radially inward (e.g., with respect to the axis 40) of the end portion 126. In some embodiments, in an installed configuration (e.g., the installed configuration 36) of the diffuser assembly 190, respective portions of the first wall 160 may extend generally along corresponding ones of the second directions 46. The second wall 164 of the inner frame 52 may extend generally along the axis 40 from the second vertex 166 to the end portion 66. Thus, in the installed configuration 36 of the diffuser assembly 190, the second wall 164 may extend generally along the vertical axis 42.

While the damper assembly 68 is in the first configuration 140, supply air flow 28 directed into the inlet 32 (e.g., via the HVAC unit 12) and entering the first flow path may impinge upon and/or otherwise flow along (e.g., due to Coanda effect-induced forces) the radially-inner surface (e.g., with respect to this axis 40) of the first wall 160. As such, the first wall 160 may redirect the supply air flow 28 flowing along the first flow path 60 in the second directions 46 to discharge of the supply air flow 28 from the diffuser assembly 190 in the second directions 46 via the first outlet 124. In contrast, while the damper assembly 68 is in the second configuration 154, supply air flow 28 directed into the inlet 32 (e.g., via the HVAC unit 12) and entering the second flow path 62 may impinge upon the radially-inner surface (e.g., with respect to this axis 40) of the second wall 164. As such, the second wall 164 may redirect the supply air flow 28 flowing along the second flow path 62 in the first direction 44 to enable discharge of the supply air flow 28 from the diffuser assembly 190 in the first direction 44 via the second outlet 128. It should be understood that the controller 170 may operate the diffuser assembly 190 in accordance with the techniques discussed above (e.g., based on feedback from the sensors 180, 182 and/or the user interface 171) to selectively transition the diffuser assembly 190 between the first configuration 140 and the second configuration 154.

Figure 8:
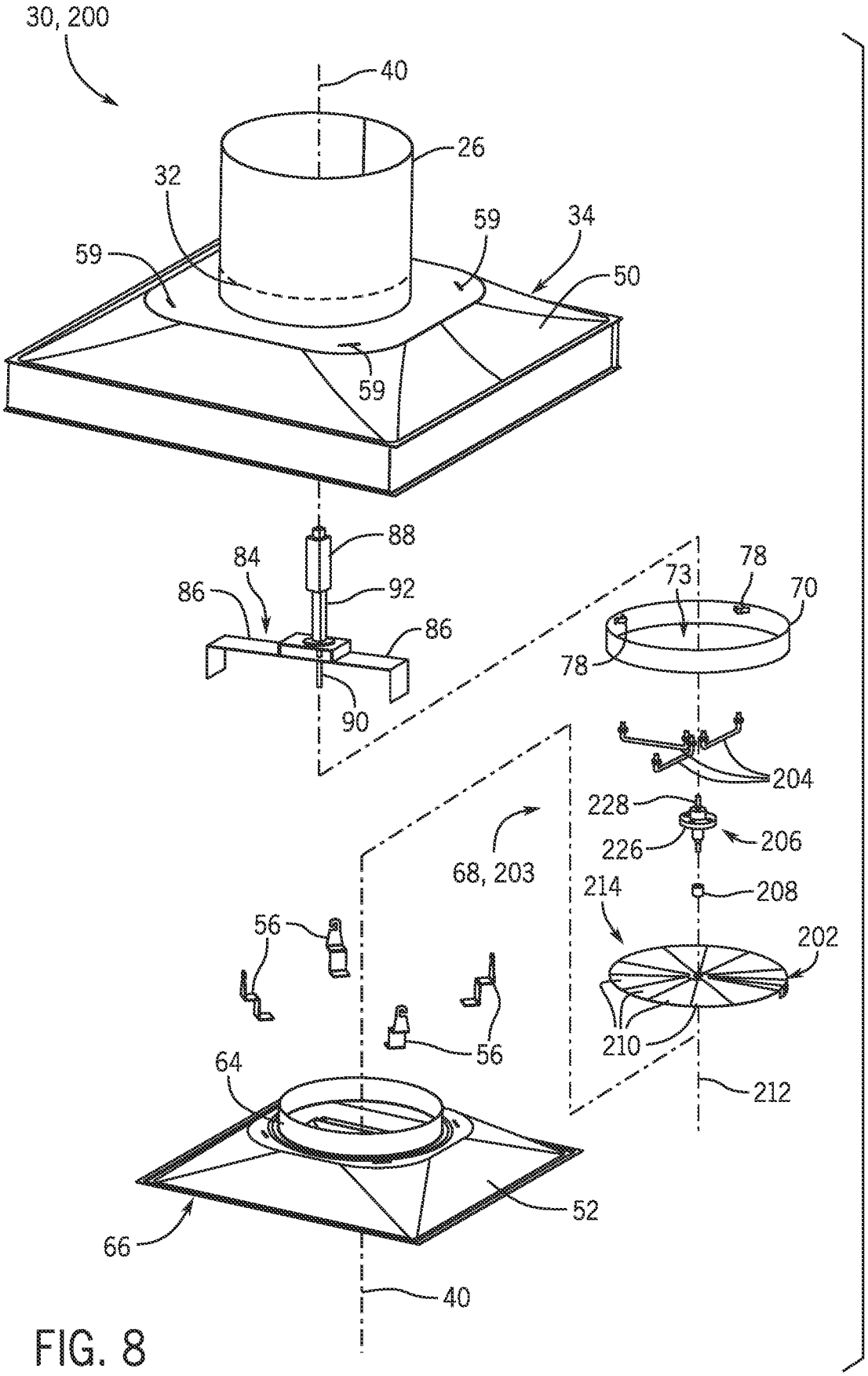
FIG. 8 is a perspective exploded view of an embodiment of the diffuser assembly of FIG. 2, illustrating a radial damper of the diffuser assembly, in accordance with an aspect of the present disclosure.

FIG. 8 is an exploded perspective view of another embodiment of the diffuser assembly 30, referred the herein as a diffuser assembly 200, in which the damper assembly 68 includes a radial damper 202 in lieu of the damper plate 72. Embodiments of the damper assembly 68 having the radial damper 202 will be referred to herein as a damper assembly 203. In the illustrated embodiment, the support frame 84 includes a pair of the arms 86, which are configured to couple to the inner frame 52. As such, when engaged with the inner frame 52, the support frame 84 supports the actuator 88 within the housing 34. The damper assembly 203 may include the perimetrical sleeve 70, a plurality of support rods 204, a cam assembly 206, a bushing 208, and the radial damper 202. It should be appreciated that in some embodiments, certain components of the damper assembly 203, such as the bushing 208, may be omitted from the damper assembly 203. Similarly, in some embodiments, the damper assembly 203 may include additional components not shown in the illustrated embodiment.

The radial damper 202 is configured to couple to the additional inlet 64 of the inner frame 52 to facilitate regulation of fluid flow through the additional inlet 64. For example, in some embodiments, the radial damper 202 may include a plurality of louvers 210 (e.g., damper blades) that are configured to rotate or pivot about a rotational axis 212 of the radial damper 202 to transition between an unstacked configuration 214, which is shown in the illustrated embodiment and in which the louvers 210 are positioned adjacent one another and are arrayed about the rotational axis 212, and a stacked configuration 216 (FIG. 9), in which the louvers 210 are aligned with one another along the rotational axis 212 and are positioned atop one another. In an installed configuration of the radial damper 202 with the additional inlet 64, the radial damper 202 may, in the unstacked configuration 214, cover or block the additional inlet 64 to substantially block air flow through the additional inlet 64. Conversely, the radial damper 202 may, when in the installed configuration with the additional inlet 64 and positioned in the stacked configuration 216, substantially uncover or unblock the additional inlet 64 to enable air flow through the additional inlet 64. In an assembled configuration 224 (FIG. 10) of the diffuser assembly 200, the rotational axis 212 of the damper assembly 203 may be aligned (e.g., concentrically) with the axis 40 of the inlet 32.

The supports rods 204 may be configured to fixedly couple a collar 226 of the cam assembly 206 to the perimetrical sleeve 70. For example, in an installed configuration of the support rods 204 with the damper assembly 203, the support rods 204 may extend between the collar 226 and the tabs 78 to couple the collar 226 to the perimetrical sleeve 70. As such, when in the installed configuration, the support rods 204 may substantially block rotational motion and translational movement of the collar 226 relative to the perimetrical sleeve 70.

A shaft 228 of the cam assembly 206 is configured to couple to the radial damper 202 (e.g., via the bushing 208) and, in an installed configuration on the radial damper 202, may be aligned concentrically to the rotational axis 212. As discussed in detail herein, the shaft 228 may be coupled to the louvers 210 and configured to transition the louvers 210 between the unstacked and stacked configurations 214, 216. As such, it should be understood that the shaft 228 may rotate about the rotational axis 212 independently of and relative to the collar 226.

In the assembled configuration 224 of the diffuser assembly 200, the actuated connector 90 may be coupled to the collar 226 and configured to translate the collar 226 along the shaft 228. In particular, the cam assembly 206 may convert translational (e.g., linear) motion of the collar 226 along the shaft 228 to rotational motion of the shaft 228 about the rotational axis 212. To this end, the actuator 88 and the cam assembly 206 may cooperate to drive movement of the perimetrical sleeve 70 along the axis 40 and to drive rotation of the louvers 210 about the rotational axis 212.

Figure 10:
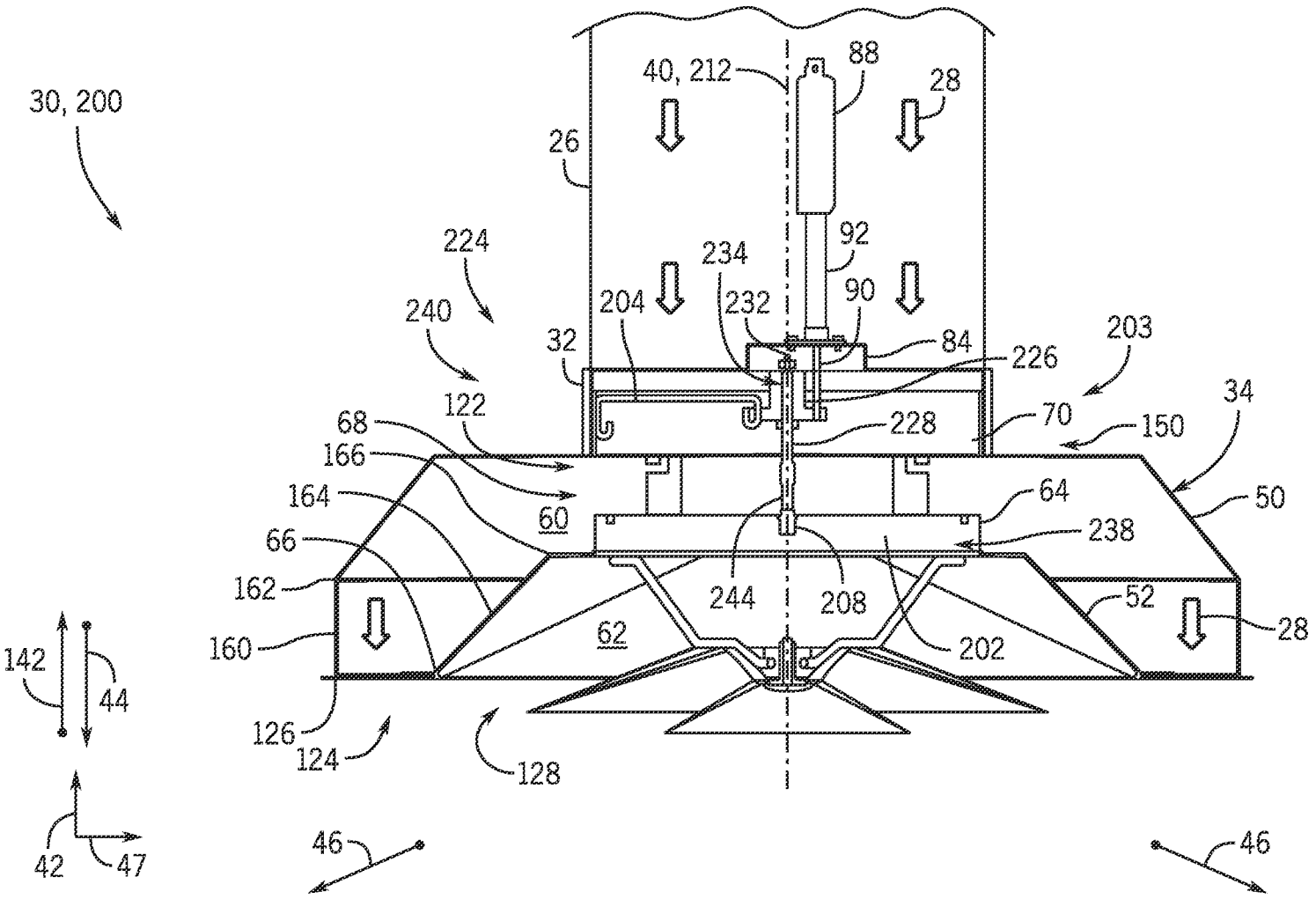
FIG. 10 is a cross-sectional elevation view of an embodiment of the diffuser assembly of FIG. 8, illustrating a damper assembly of the diffuser assembly in a first configuration, in accordance with an aspect of the present disclosure.
Figure 11:
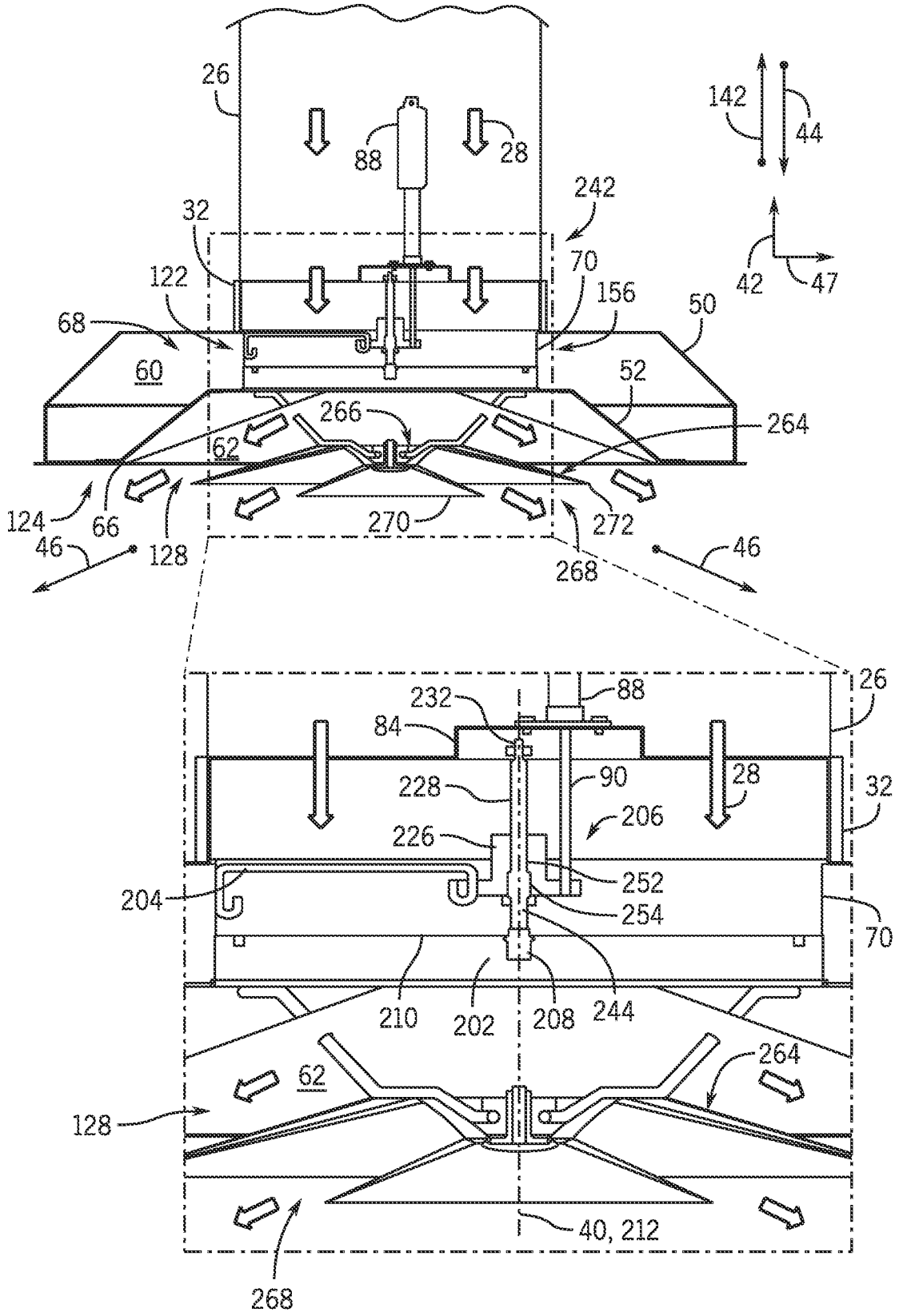
FIG. 11 is a cross-sectional elevation view of an embodiment of the diffuser assembly of FIG. 8, illustrating the damper assembly of the diffuser assembly in a second configuration, in accordance with an aspect of the present disclosure.

For example, to better illustrate the operation of the diffuser assembly 200 and to facilitate the following discussion, FIG. 10 is a cross-sectional elevation view of an embodiment of the diffuser assembly 200. In illustrated embodiment, the actuator 88 is coupled to the housing 34 via the support frame 84 and the actuated connector 90 is coupled to the collar 226. The actuated connector 90 may be offset from the axis 40 such that, when the actuated connector 90 is engaged with (e.g., fixedly coupled to) the collar 226, the actuated connector 90 blocks rotation of the collar 226 about the shaft 228 and about the axis 40. As discussed above, the collar 226 may be coupled to the perimetrical sleeve 70 via the support rods 204. Accordingly, the actuator 88 may, by translating the collar 226 along the shaft 228 and relative to the housing 34, transition the perimetrical sleeve 70 between the second position 150 and the third position 156 (FIG. 11). In the illustrated embodiment of FIG. 10, the actuated connector 90 is in a retracted position, such that the collar 226 is positioned at or adjacent a first end portion 232 of the shaft 228 and the perimetrical sleeve 70 is positioned in the second position 150 to expose the gap 122.

In the illustrated embodiment of FIG. 10, the shaft 228 extends through a passage 234 formed in the collar 226 and is coupled to the louvers 210 via, for example, the bushing 208. Moreover, the shaft 228 is positioned in a first rotational orientation. In the first rotational orientation, the shaft 228 positions the louvers 210 in the unstacked configuration 214 (FIG. 8) and, thus, the radial damper 202 is in a closed configuration 238, whereby air flow through the radial damper 202 is substantially blocked. Therefore, in the closed configuration 238, the radial damper 202 may substantially block or inhibit air flow through the additional inlet 64.

As used herein, the damper assembly 203 may be in a first configuration 240 when the radial damper 202 is in the closed configuration 238 and the perimetrical sleeve 70 is in the second position 150. As such, in the first configuration 240 of the damper assembly 203, the damper assembly 203 may enable air flow through the first flow path 60 and the first outlet 124 while substantially blocking air flow through the second flow path 62 and the second outlet 128.

FIG. 11 is a cross-sectional elevation view of an embodiment of the diffuser assembly 200, illustrating the damper assembly 203 in a second configuration 242, whereby the damper assembly 203 blocks air flow through the first flow path 60 and enables air flow through the second flow path 62. To transition the damper assembly 203 to the second configuration 242, the actuator 88 may extend the actuated connector 90 in the third direction 142 to translate the collar 226 along the shaft 228 and toward a second end portion 244 of the shaft 228, opposite the first end portion 232. Accordingly, the actuator 88 may transition the perimetrical sleeve 70 to the third position 156, in which the perimetrical sleeve 70 extends across or otherwise covers the gap 122 to substantially block air flow through the gap 122. In the third position 156, the perimetrical sleeve 70 may abut a portion of the inner frame 52, overlap with a portion of the additional inlet 64, and/or abut the radial damper 202, for example.

Figure 9:
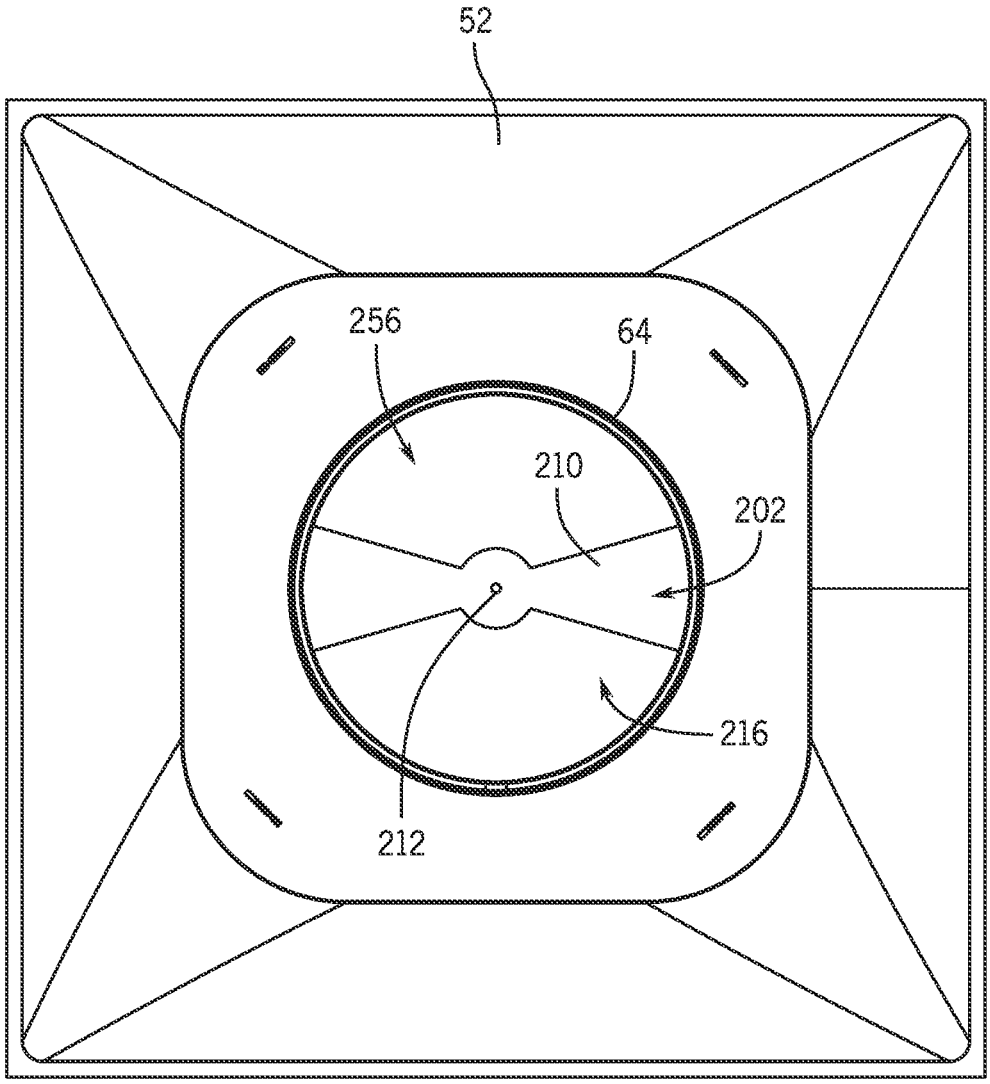
FIG. 9 is a top view of an embodiment of a portion of the diffuser assembly of FIG. 8, in accordance with an aspect of the present disclosure.

In some embodiments, an inner surface of the collar 226 (e.g., a surface defining the passage 234 through the collar 226) may include one or more grooves 252, threads, or other profiles formed thereon. The shaft 228 may include one or more cams 254, lobes, threads, or other protrusions formed near or coupled to the second end portion 244 of the shaft 228. When the actuated connector 90 drives the collar 226 to and along the second end portion 244 of the shaft 228, the cams 254 may be configured to gradually engage with and translate along the grooves 252. In some embodiments, the grooves 252 may extend helically along the inner surface of the collar 226. Accordingly, when the cams 254 translate along the grooves 252, such as when the actuated connector 90 forces the collar 226 in the first direction 44, the engagement between the cams 254 and the grooves 252 may induce rotational motion of the shaft 228 about the rotational axis 212 (e.g., about the axis 40). In this way, the shaft 228 may rotate the louvers 210 about the rotational axis 212 to transition the louvers 210 from the unstacked configuration 214 to the stacked configuration 216 (FIG. 9). As such, the shaft 228 may transition the radial damper 202 to an open configuration 256 (FIG. 9), in which the louvers 210 are in the stacked configuration 216 to substantially unblock the additional inlet 64 and enable air flow through the radial damper 202. It should be appreciated that, in other embodiments, the grooves 252 of the collar 226 may be replaced with protrusions that extend from the inner surface of the collar 226 and are configured to engage with corresponding grooves formed on the shaft 228 (e.g., in lieu of the cams 254) to facilitate operation of the damper assembly 203 in accordance with the aforementioned techniques.

As described herein, the damper assembly 203 may be in the second configuration 242 when the radial damper 202 is in the open configuration 256 and the perimetrical sleeve 70 is in the third position 156. As such, in the second configuration 242 of the damper assembly 203, the damper assembly 203 may block air flow through the first flow path 60 and the first outlet 124 and enable air flow through the second flow path 62 (e.g., via the additional inlet 64) and the second outlet 128. In the illustrated embodiment of FIG. 11, diffuser assembly 200 does not include the cover plate 96. Instead, the second outlet 128 of the diffuser assembly 200 extends between the end portion 66 of the inner frame 52 and an intermediate frame 264, which may be coupled to the inner frame 52. In some embodiments, the intermediate frame 264 may include an intermediate inlet 266 that is configured to receive a portion of the air flowing through the additional inlet 64 and discharge the portion of the air through a third outlet 268 of the diffuser assembly 200 that extends between a cap plate 270 of the inner frame 52 and an end portion 272 of the intermediate frame 264. In some embodiments, the second outlet 128 and the third outlet 268 may each be configured to discharge air from the diffuser assembly 200 in the second directions 46.

It should be understood that the controller 170 may operate the diffuser assembly 200 in accordance with the techniques discussed above to selectively transition the diffuser assembly 200 between the first configuration 240 to enable discharge of the supply air flow 28 in the first direction 44 via the first outlet 124, and the second configuration 242 to enable discharge of the supply air flow 28 in the second directions 46 via the second outlet 128 and/or the third outlet 268. In this manner, the controller 170 may selectively adjust a direction air discharge from the diffuser assembly 200 to mitigate or substantially eliminate the shortcomings of typical diffusers set forth above. Moreover, it should be appreciated that, in some embodiments, the first outlet 124 of the diffuser assembly 200 may be configured to guide discharge of air in the second directions 46 while the second outlet 128 and/or the third outlet 268 are configured to guide discharge of air in the first direction 44. In other words, other configurations of the diffuser assembly 200 (e.g., the damper assembly 203) may be configured to discharge air in the first direction 44 via the second outlet 128 and/or the third outlet 268 when the diffuser assembly 200 is in the second configuration 242 and discharge air in the second directions 46 via the first outlet 124 when the diffuser assembly 200 is in the first configuration 240.

Figure 12:
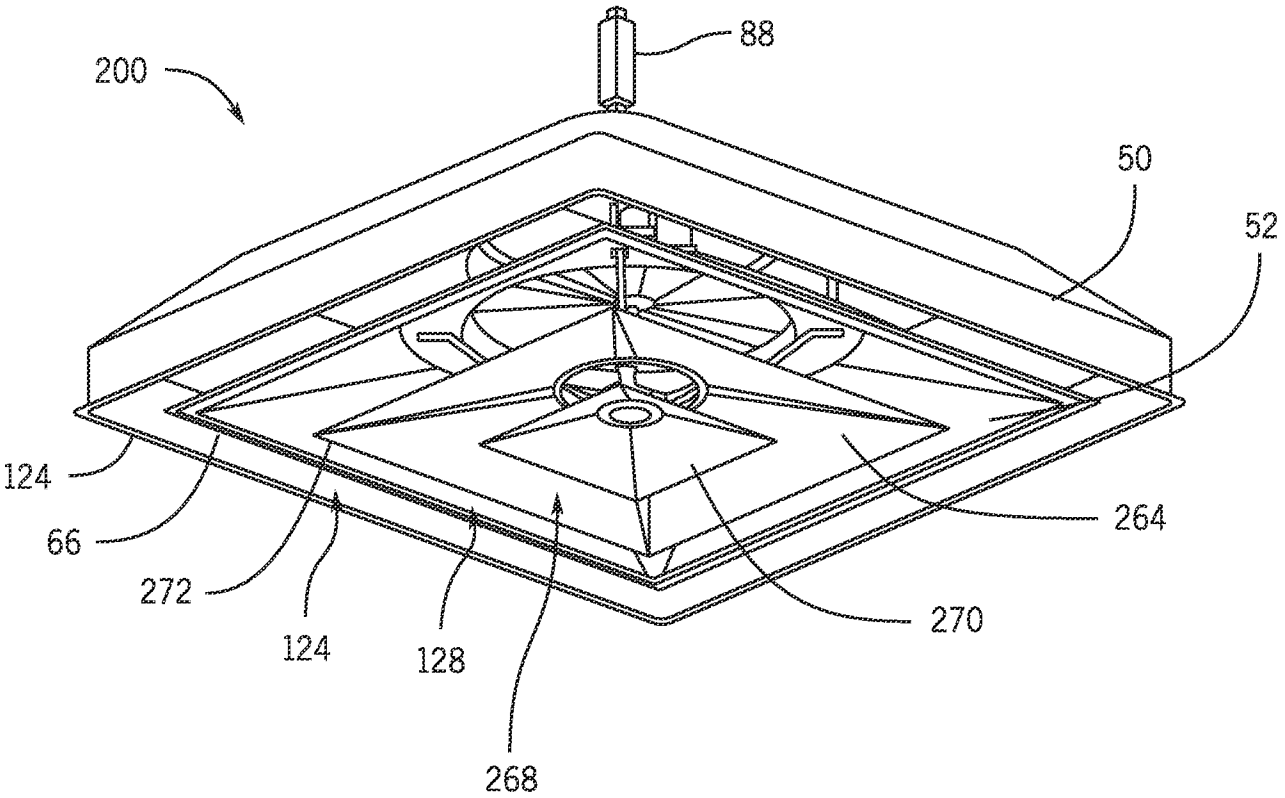
FIG. 12 is a bottom perspective view of an embodiment of the diffuser assembly of FIG. 8, in accordance with an aspect of the present disclosure.

FIG. 12 is a bottom perspective view of an embodiment of the diffuser assembly 200. As shown in the illustrated embodiment, the first outlet 124 may extend about or otherwise encircle the second outlet 128, and the second outlet 128 may extend about or otherwise encircle the third outlet 268. However, it should be appreciated that other embodiments of the diffuser assembly 200 may have other configurations that position or form the first outlet 124, the second outlet 128, and/or the third outlet 268 in other arrangements relative to one another.

As set forth above, embodiments of the present disclosure may provide one or more technical effects useful for mitigating or substantially eliminating stratification of conditioned air within a room or other space to be conditioned via utilization of an adjustable diffuser assembly. In particular, the diffuser assembly disclosed herein is adjustable to enable discharge of air into the space in various discharge directions based on one or more parameters of an HVAC system, for example. In this manner, the diffuser assembly facilitates more effective air distribution throughout the space. For example, the diffuser assembly is configured to adjust or select a discharge direction of air directed into the space based on whether the HVAC system is operating in a cooling mode to supply cooled air to the space or a heating mode to supply heated air to the space. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A diffuser assembly for a heating, ventilating, and air conditioning (HVAC) system, comprising:

an outer frame comprising a first inlet configured to receive an air flow;

an inner frame disposed within the outer frame and forming a first flow path for the air flow between the outer frame and the inner frame, wherein the inner frame defines a second flow path for the air flow through the inner frame; and a damper assembly configured to transition between a first configuration to enable discharge of the air flow from the diffuser assembly via the first flow path and a second configuration to enable discharge of the air flow from the diffuser assembly via the second flow path, wherein the damper assembly comprises:

a radial damper configured to block flow of the air flow via the second flow path in the first configuration; and a perimetrical sleeve spaced apart from the radial damper and configured to block flow of the air flow via the first flow path in the second configuration.

2. The diffuser assembly of claim 1, comprising a first outlet that extends between a surface of the inner frame and a surface of the outer frame, wherein the first outlet is configured to receive the air flow from the first flow path and guide discharge of the air flow from the diffuser assembly in a generally vertical direction with respect to an axis extending through the first inlet in a direction of the air flow.

3. The diffuser assembly of claim 2, wherein the inner frame comprises a second inlet configured to receive the air flow from the first inlet, and the inner frame defines a second outlet configured to receive the air flow from the second flow path and guide discharge of the air flow from the diffuser assembly in a generally lateral direction with respect to the axis extending through the first inlet in the direction of the air flow.

4. The diffuser assembly of claim 1, wherein the damper assembly is coupled to the inner frame, wherein the perimetrical sleeve is configured to translate from the first configuration to the second configuration in a generally vertical direction with respect to an axis extending through the first inlet in a direction of the air flow, and wherein the radial damper is configured to rotate about the axis from the first configuration to the second configuration.

5. The diffuser assembly of claim 4, comprising an actuation system configured to actuate transition of the damper assembly between the first configuration and the second configuration, wherein the actuation system comprises an actuator coupled to the perimetrical sleeve via an actuated connector, and wherein translation of the actuator connector is configured to cause rotation of the radial damper.

6. The diffuser assembly of claim 1, comprising an actuator coupled to the damper assembly and comprising a cam assembly coupled to the perimetrical sleeve and the radial damper, wherein:

the radial damper is coupled to the inner frame, and the radial damper comprises one or more louvers configured to pivot about an axis of the radial damper, the perimetrical sleeve is configured to translate along the axis, via actuation of the actuator, to transition between a first position and a second position, and the cam assembly is configured to convert translational movement of the actuator along the axis into pivotal motion of the one or more louvers about the axis.

7. The diffuser assembly of claim 6, wherein the cam assembly is configured to transition the one or more louvers to an unstacked configuration to block the air flow along the second flow path when the damper assembly is in the first configuration and to transition the one or more louvers to a stacked configuration to enable flow of the air flow along the second flow path when the damper assembly is in the second configuration.

8. The diffuser assembly of claim 1, comprising:

an actuator coupled to the damper assembly and configured to transition the damper assembly between the first configuration and the second configuration; and a controller communicatively coupled to the actuator, wherein the controller is configured to instruct the actuator to adjust a position of the damper assembly based on sensor feedback indicative of an operating parameter of the HVAC system, an operating mode of the HVAC system, or user input received via a user interface of the HVAC system.

9. The diffuser assembly of claim 1, wherein the first flow path terminates at a first outlet of the diffuser assembly, the second flow path terminates at a second outlet of the diffuser assembly, the first outlet is configured to guide discharge of the air flow from the diffuser assembly in a generally vertical direction with respect to an axis extending through the first inlet, and the second outlet is configured to guide discharge of the air flow from the diffuser assembly in a generally lateral direction with respect to the axis.

10. A diffuser assembly for a heating, ventilating, and air conditioning (HVAC) system, comprising:

an outer frame comprising a first inlet configured to receive an air flow;

an inner frame disposed within the outer frame and comprising a second inlet configured to receive the air flow from the first inlet, wherein the inner frame and outer frame form a first outlet of the diffuser assembly therebetween, and the inner frame defines a second outlet of the diffuser assembly; and a damper assembly coupled to the outer frame, the inner frame, or both, wherein the damper assembly comprises a radial damper and a perimetrical sleeve spaced apart from the radial damper, and the damper assembly is configured to transition between a first configuration to direct the air flow through a first flow path of the diffuser assembly extending from the first inlet to the first outlet and to block the air flow through a second flow path of the diffuser assembly extending from the first inlet, through the second inlet, and to the second outlet, and a second configuration to direct the air flow through the second flow path and to block the air flow through the first flow path.

11. The diffuser assembly of claim 10, wherein the first outlet is configured to guide discharge of the air flow from the first flow path in a first direction generally parallel to an axis extending through the first inlet or the second inlet, and the second outlet is configured to guide discharge of the air flow from the second flow path in a second direction oblique to the axis.

12. The diffuser assembly of claim 10, wherein the outer frame and the inner frame form a gap extending between the first inlet and the second inlet, wherein the damper assembly is configured to guide the air flow through the gap in the first configuration and block flow of the air flow through the gap in the second configuration.

13. The diffuser assembly of claim 12, wherein the perimetrical sleeve is configured to translate along an axis extending through the first inlet or the second inlet, wherein the perimetrical sleeve is positioned to enable air flow through the gap in the first configuration of the damper assembly and is positioned to block air flow through the gap in the second configuration of the damper assembly.

14. The diffuser assembly of claim 13, wherein the radial damper is configured to rotate about the axis, and wherein the radial damper is configured to couple to the inner frame, to block air flow through the second inlet in the first configuration of the damper assembly, and to enable air flow through the second inlet in the second configuration of the damper assembly.

15. The diffuser assembly of claim 13, wherein the radial damper comprises one or more louvers configured to transition between an unstacked configuration to block air flow through the second inlet in the first configuration and a stacked configuration to enable air flow through the second inlet in the second configuration, and the damper assembly further comprises a cam assembly coupled to the perimetrical sleeve and the radial damper, wherein the cam assembly is configured to convert translational movement of an actuator along the axis into pivotal motion of the one or more louvers about the axis, and wherein the cam assembly is configured to transition the one or more louvers to the unstacked configuration in the first configuration of the damper assembly and to the stacked configuration in the second configuration of the damper assembly.

16. The diffuser assembly of claim 10, comprising:

an actuator coupled to the damper assembly and configured to transition the damper assembly between the first configuration and the second configuration; and a controller communicatively coupled to the actuator and configured to transmit instructions to the actuator to cause the actuator to adjust the damper assembly between the first configuration and the second configuration.

17. A heating, ventilating, and air conditioning (HVAC) system, comprising:

a diffuser assembly, comprising:

an outer frame comprising an inlet configured to receive an air flow from ductwork;

an inner frame disposed within the outer frame to form a first flow path for the air flow through the diffuser assembly between the outer frame and the inner frame, wherein the inner frame defines a second flow path, separate from the first flow path, for the air flow through the diffuser assembly;

a damper assembly coupled to the inner frame, wherein the damper assembly comprises a radial damper coupled to a perimetrical sleeve, and the damper assembly is configured to transition between a first configuration to enable discharge of the air flow from the diffuser assembly via the first flow path and a second configuration to enable discharge of the air flow from the diffuser assembly via the second flow path; and an actuator configured to cause translation of the perimetrical sleeve along an axis and cause rotation of the radial damper about the axis to transition the damper assembly between the first configuration and the second configuration; and a controller communicatively coupled to the actuator and configured to instruct the actuator to transition the damper assembly between the first configuration and the second configuration based on an input received via the controller.

18. The HVAC system of claim 17, wherein the input comprises an operating parameter of the HVAC system, and the operating parameter comprises an operational mode of the HVAC system, a temperature of the air flow, a temperature of a space to be conditioned by the HVAC system, or a combination thereof.

19. The HVAC system of claim 17, wherein the input comprises a user input received via a user interface of the HVAC system.

20. The HVAC system of claim 17, wherein the radial damper is configured to block flow of the air flow via the second flow path in the first configuration, and the perimetrical sleeve is configured to block flow of the air flow via the first flow path in the second configuration.

* * * * *